US006475025B2

(12) United States Patent
Inoue

(10) Patent No.: US 6,475,025 B2
(45) Date of Patent: Nov. 5, 2002

(54) FLEXIBLE FLAT CABLE CONNECTOR WITH SLIDING MEMBER

(75) Inventor: Takuya Inoue, Nagoya (JP)

(73) Assignees: Autonetworks Technologies, Ltd., Aichi (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/897,501

(22) Filed: Jul. 3, 2001

(65) Prior Publication Data

US 2002/0013086 A1 Jan. 31, 2002

(30) Foreign Application Priority Data

Jul. 4, 2000 (JP) ..... 2000-201857
Jul. 7, 2000 (JP) ..... 2000-206134
Jul. 21, 2000 (JP) ..... 2000-220121

(51) Int. Cl.[7] ..... H01R 9/07
(52) U.S. Cl. ..... 439/495; 439/342
(58) Field of Search ..... 439/495, 496, 439/493, 632, 606, 405, 492, 499; 639/342

(56) References Cited

U.S. PATENT DOCUMENTS 6,010,359 A * 1/2000 Etters et al. ..... 439/496
6,036,520 A * 3/2000 Tojo ..... 439/260
6,165,008 A * 12/2000 Wu et al. ..... 439/492

FOREIGN PATENT DOCUMENTS

JP 5-69880 9/1993
JP 8-83631 3/1996

* cited by examiner

*Primary Examiner*—Renee Luebke
*Assistant Examiner*—Phuong Nguyen
(74) *Attorney, Agent, or Firm*—Oliff & Berridge, PLC

(57) ABSTRACT

A connector in which a slider 30 is pushed into a housing 20 in a state in which a terminal of a flexible wiring member 40 has been inserted in the housing 20, thereby holding the terminal of the flexible wiring material 40 at a position where its conductors are brought into contact with terminals 10. A guiding mechanism for the slider 30, including a guide portion 36 and the like, is provided. At the time of the pushing of the slider, the slider 30 is guided such that after being slid in a first direction which is inclined in the direction of approaching conductors of the wiring member 40 with respect to an inserting direction of the wiring member, the slider 30 is slid in a second direction parallel to the inserting direction of the wiring member.

18 Claims, 27 Drawing Sheets

FLEXIBLE FLAT CABLE CONNECTOR WITH SLIDING MEMBER

BACKGROUND OF THE INVENTION

1. Technical Field

The present invention relates to a connector to which is connected a terminal of a flexible wiring member, such as a flexible flat cable (FFC) in which a plurality of conductors are arranged parallel to each other in the longitudinal direction and a flexible printed circuit (FPC) having a circuit printed on a flexible base material.

2. Related Art

Conventionally, as a means for connecting a terminal of a flexible wiring member to, for example, a circuit board, one is known in which a connector to which the terminal is connectable is mounted on a substrate. In such a connector, in view of the fact that the flexible wiring member which is connected is liable to deflect and the insertion is difficult, an arrangement is provided such that the terminal of the flexible wiring member is made insertable in a housing in a state in which the resistance is practically nil, and after the insertion a slider is pushed into the housing in a direction parallel to the inserting direction of the flexible wiring member, thereby restraining the flexible wiring member at a connecting position.

However, with the connector in which the slider is thus pushed in in a direction parallel to the inserting direction of the flexible wiring member, there is a drawback in that the slider which is pulled out toward this side constitutes a hindrance, so that the insertion of the flexible wiring member into the housing is difficult. Accordingly, as a means for overcoming such a drawback, the Unexamined Japanese Patent Application Publication No. Hei8-83631 discloses a connector in which when the slider is pulled out, the overall slider is arranged to tilt in a direction in which a terminal on this side of the slider is oriented diagonally upward, thereby widening the insertion gap for the flexible wiring member by the tilting of the slider at this pulled-out position.

[Problems to be Solved]

With the connector of the above-described publication, since the motion of rotating the slider is involved at the beginning of the pushing in or before completion of the pulling out of the slider, there is a drawback in that the operation of the slider becomes complicated. Particularly with the connector in which the flexible wiring member is inserted in a state in which the flexible wiring member is mounted on a substrate, there are many cases where the connecting operation in a narrow space is required, so that it is desirable to simplify the slider operation as much as possible.

It should be noted that although the Unexamined Japanese Utility Model Application Publication No. Hei5-69880 concerning a microfilm discloses a substrate-mounted connector in which a slider is pulled out from a housing diagonally upward in a straight manner (i.e., the slider is pushed into the housing diagonally downward), this connector is aimed at avoiding interference between the slider which is pulled out of the housing and an electronic part mounted on this side of the connector. Since the arrangement provided is such that a terminal of the flexible wiring member is inserted into the housing over the slider which is pulled out diagonally upward, the insertion operation is even more difficult, and it is very difficult to visually confirm the inserted state.

In addition, with the connector disclosed in the Unexamined Japanese Utility Model Application Publication No. Hei5-69880 concerning a microfilm, the slider is arranged to slide in a diagonal direction over its entire stroke, and since it does not provide the operation of pushing in the slider in a direction parallel to the inserting direction of the flexible wiring member, it is difficult to reliably hold the flexible wiring member at a position of contact with connector terminals. Furthermore, in a case where the slider is retained at its insertion-completed position in such a manner as to be incapable of moving backward, if there is any slight deviation in its retaining position, the force for restraining the flexible wiring member by the slider at that retaining position varies, so that there is a drawback in that the connection reliability declines by that margin.

An example of such a connector is shown in FIG. 16 and FIGS. 19A to 19C. A multiplicity terminal accommodating chambers 182 arranged in a lateral direction are formed in an illustrated housing 180, and terminals 184 are respectively accommodated in the terminal accommodating chambers 182. A vertically deflectable deflecting piece 183 for connection is formed at a tip of each of the terminals 184.

To effect connection by using this connector C1 for a circuit board, the housing 180 is first fixed to a circuit board side by a pair of holders 186, and leg portions 185 of the terminals 182 are connected to lands on an unillustrated board by means of soldering or the like. Meanwhile, in a flexible wiring member 140, its terminal is processed to expose terminals of respective conductors 141 on the upper side, and a reinforcing plate 142 for restraining the deflection of the terminal of the flexible wiring member 140 is bonded in advance to a reverse surface of the terminal. Then, after the terminal of the flexible wiring member 140 is inserted into the housing 180 in a loosely fitted state, as shown in FIGS. 19A and 19B, a slider 190 having a tongue 192 is inserted from the inserting side. Upon completion of the insertion of the slider 190 (FIG. 19C), the tongue 192 pushes up the terminals of the conductors 141 of the flexible wiring member 140, thereby allowing the terminals of the conductors 141 to be brought into contact with the deflecting pieces 183 of the terminals 182. Through this contact, the flexible wiring member 140 is set in a state of being connected to a circuit on the circuit board side by means of the terminals 182.

With the above-described connector C1, it is difficult to confirm to what extent the terminal of the flexible wiring member 140 has been inserted in the housing 180. Accordingly, due to the fact that the slider 190 is pushed in in a state in which the flexible wiring member 140 is in a semi-inserted state, there is a possibility of the occurrence of faulty connection. In addition, even if the connecting operation is conducted satisfactorily, since the restraint of the flexible wiring member 140 is effected only by the clamping by the tongue 192 and the deflecting pieces 183, if the flexible wiring member 140 is, for example, pulled with a relatively strong force, the position of the terminal in the housing can be offset, possibly causing faulty connection.

To hold down nearly the entire region extending in the direction of width of the flat wiring member 240, the slider 290 is shaped in such a manner as to extend in the direction of the member 240. Moreover, both terminals in the direction of width of the flat wiring member 240 are restrained to the housing 280, while a middle portion in the direction of width thereof freely operates at least in the direction in which the slider 290 is pushed into the housing 280. Therefore, as the width of the flat wiring member 240 is increased by multipolarization thereof, the width dimension of the slider 290 increases. Thus, the middle portion in the direction of width of the slider 290 becomes more flexible (that is, becomes more liable to perform displacement) in the direction in which the slider 290 is inserted (that is, in a direction nearly parallel to the direction in which the flat wiring member 240 is inserted). When such displacement occurs, the middle portion in the direction of width thereof cannot reliably restrain the flat wiring member 240 at a normal connection position (that is, the position at which the member 240 touches the terminal 284). There is a fear that contact failure occurs at worst.

SUMMARY OF THE INVENTION

In view of the above-described circumstances, an object of the invention is to provide a connector which facilitates the operation of connection between the flexible wiring member inserted in the housing and the terminals, and makes it possible to reliably and stably maintain the connection.

[Means for Solving the Problems]

As a means for attaining the above object, in accordance with the invention, there is provided a connector to which a terminal of a flat flexible wiring member is connected, comprising: a housing into which the terminal of the flexible wiring member is insertable; a plurality of terminals provided in the housing and respectively having conductor contacting portions for contacting conductors at the terminal of the flexible wiring member inserted in the housing; and a slider for restraining the terminal of the flexible wiring member at a position where the conductors are respectively brought into contact with the conductor contacting portions of the terminals as the slider is pushed into the housing in a direction including its inserting-direction component in a state in which the terminal of the flexible wiring member has been inserted in the housing; and a guiding mechanism for guiding the slider such that, in conjunction with the pushing in of the slider, the slider is slid in a first direction which is inclined in a direction of approaching the conductors of the flexible wiring member with respect to the inserting direction of the flexible wiring member, and is subsequently slid in a second direction parallel to the inserting direction of the flexible wiring member.

In the above-described construction, since the sliding direction of the slider includes a first direction which is inclined with respect to the inserting direction of the flexible wiring member, in a state in which the slider is pulled out of the housing, the position of the slider is spaced apart from the inserting position of the flexible wiring member, thereby widening the insertion gap of the flexible wiring member so as to facilitate the insertion. Meanwhile, after the insertion of the flexible wiring member, the slider is made to gradually approach the flexible wiring member by its sliding in the first direction, so that the conductors of the flexible wiring member can be brought into pressure contact with the conductor contacting portions of the terminals by this slider. Moreover, since the arrangement provided is such that the slider slides in the second direction parallel to the inserting direction of the flexible wiring member after its sliding in the first direction, as compared with the conventional arrangement in which the slider slides only in a diagonal direction, the pressure contact between the conductors of the flexible wiring ember and the conductor contacting portions of the terminals an be maintained in a reliable and stable state.

As the guiding mechanism, one is preferable in which a guide portion which is formed by one of a protrusion and a groove and in which a first guide portion extending in the first direction and a second guide portion extending in the second direction continue is provided on one of the housing and the slider, while a restraining portion which, while being fitted to the guide portion, restrains the movement of the guide portion in a direction perpendicular to a longitudinal direction of the guide portion while permitting the sliding of the guide portion in its longitudinal direction. According to this arrangement, the sliding of the slider along the first direction and the second direction can be realized by a simple structure merely combining the guide portion and the restraining portion.

In the invention, since an arrangement is provided such that the housing is provided with a retaining portion for retaining the slider which slid to an innermost side in the second direction to restrain the backward movement thereof, it becomes possible to more reliably maintain the state of connection between the flexible wiring member and the terminals. Here, in the case of a connector in which the slider slides only in an inclined direction as in a conventional manner, since the force with which the flexible wiring member is brought into pressure contact with the terminals by the slider varies depending on the sliding position of the slider. Therefore, if the position of retaining the slider by the retaining portion varies, the force with which the slider presses the flexible wiring member against the terminals at that retaining position varies. However, with the connector in which the slider is finally adapted to slide in the second direction, i.e., in a direction parallel to the inserting direction of the flexible wiring member, as in the invention, even it there is slight variation in the retaining position, the force with which the flexible wiring member is pressed by the slider does not undergo change. Hence, the state of pressure contact between the flexible wiring member and the terminals can be stabilized further.

Although a specific structure for effecting the above-described retention is not limited, if an arrangement is provided such that the guide portion is provided projectingly on the slider, a portion to be retained is provided integrally with the guide portion, and the housing is provided with a retaining portion for restraining the backward movement of the slider by engaging the portion to be retained of the slider which has slid to an innermost side in the second direction, the retention can be realized with a simple structure by making use of the guide portion projecting from the slider.

Further, if an arrangement is provided such that the housing is provided with a stopper for preventing the slider from coming off the housing in a direction opposite to the pushing-in direction of the slider as the stopper abuts against the guide portion, it is also possible to effect the prevention of the slider from coming off the housing by making use of the guide portion.

The specific inserting direction of the flexible wiring member and the specific sliding direction of the slider can be set, as required. However, if the first direction among the sliding directions of the slider is a diagonally downward direction, and the flexible wiring member is arranged to be inserted into the housing from a lower side of the slider, so as to allow the position of the inserted end of the flexible wiring member to be confirmed from above, it is possible to further facilitate the operation of inserting the terminal of the flexible wiring member.

Further, as described above, the terminal of the flexible wiring member is generally provided with a reinforcing plate for suppressing its deflection, and therefore the flexible wiring member is in such a state that the reinforcing plate projects from the surface of the flexible wiring member by the portion of its thickness.

The invention has been devised by taking note of the above-described structure, and there is provided a connector to which a terminal of a flat flexible wiring member with a reinforcing plate fixed to the terminal is connected, comprising a housing into which the terminal of the flexible wiring member is insertable; a plurality of terminals provided in the housing and respectively having conductor contacting portions for contacting conductors at the terminal of the flexible wiring member inserted in the housing; and a slider for restraining the terminal of the flexible wiring member at a position where the conductors are respectively brought into contact with the conductor contacting portions of the terminals, wherein a restraining portion is provided on the slider for restraining the movement of the flexible wiring member in a direction opposite to an inserting direction of the flexible wiring member as the restraining portion abuts against the reinforcing plate in the inserting direction of the flexible wiring member, and as the slider is pushed into the housing in a state in which the reinforcing plate is located on a further forward side in the inserting direction of the flexible wiring member than the restraining portion, the conductors of the terminal of the flexible wiring member are held at a position for contacting the conductor contacting portions of the terminals.

In accordance with the above-described construction, even if the slider is pushed in even if the flexible wiring member has not been completely inserted into the housing, since the restraining portion provided on the slider pushes from behind the reinforcing plate provided on the terminal of the flexible wiring member from the rear side in the inserting direction, the terminal of the flexible wiring member is finally guided to a proper connecting position (the position where the conductors of the terminal are brought into contact with the conductor contacting portions) at the point of time of completion of the pushing in of the slider. In addition, in the state in which the pushing in has thus been completed, since the restraining portion located on the rear side in the inserting direction of the reinforcing plate restrains the backward movement of the reinforcing plate and, hence, the overall flexible wiring member, even if some tension is applied to the flexible wiring member, it is possible to prevent the offsetting of the terminal of the flexible wiring member from the connecting position.

Further, if an arrangement is provided such that a retaining portion is provided on the housing for retaining the slider pushed in to restrain the backward movement of the slider, and a position of retaining the slider by the retaining portion is set so that as the slider is retained by the retaining portion in a state in which the reinforcing plate is located on a further forward side in the inserting direction of the flexible wiring member than the restraining portion, the conductors of the terminal of the flexible wiring member are held at the position for contacting the conductor contacting portions of the terminals, since the backward movement of the slider itself can be restrained by the retaining portion, the state of connection between the flexible wiring member and the connector-side terminals can be maintained more reliably.

It suffices if the restraining portion is adapted to restrain the movement of the reinforcing plate by abutting against the reinforcing plate from the rear side in the inserting direction of the flexible wiring member. For example, in a case where the flexible wiring member is arranged to be inserted into the housing in a state in which a surface of the flexible wiring member on which the reinforcing plate is provided is oriented to oppose the slider, by providing a simple structure in which, on a surface of the slider for opposing the flexible wiring member, a projecting portion projecting from the surface toward the flexible wiring member is provided as the restraining portion, it is possible to effectively restrain the movement of the flexible wiring member.

Still further, to achieve the foregoing object, according to the invention, there is provided a connector, to which a terminal of a flat wiring member is connected. This connector comprises a housing in which the terminal of the flat wiring member enabled to be inserted, terminals provided in the housing and adapted to touch conductors of the terminal of the flat wiring member, and a slider adapted to extend in a direction of width of the flat wiring member and to restrain conductors of the terminal of the flat wiring member in a position, in which the conductors of the terminal of the flat wiring member touch the terminal, by being pushed into the housing in a direction including a component of a direction in which the flat wiring member is inserted thereinto. In this connector, a to-be-latched portion is provided in a middle portion in the direction of width of the slider. Further, latching portions for restraining the middle portion by engaging with the to-be-latched portion of the slider, which is pushed into the housing, from bending in the direction, in which the slider is pushed into said housing, are provided in the housing.

Incidentally, the "middle portion in the direction of width of the slider" referred to herein is not limited to a portion located at the accurately central portion of the slider. Portions other than both end parts of the slider, that is, other than parts, which substantially do not bend, may be employed as the middle portion in the direction of width of the slider.

With the aforementioned configuration, when the to-be-latched portion provided in the middle portion in the direction of width of the slider engages with the latching portions of the housing during the slider is pushed into the housing, the middle portion in the direction of width of the slider is restrained from bending in the direction in which the slider is pushed in the housing. Therefore, the terminal of the flat wiring member, which includes the middle portion in the direction of width of the slider, can be reliably restrained in the normal connection position (that is, the position at which the terminal touches the terminal) across the entire region in the direction of width thereof.

Incidentally, in the case that the latching portions are formed in such a way as to be integral with the housing, the slider can be restrained by a simple configuration without increasing the number of parts from bending.

Practically, it is preferable that the housing and the latching portions are integrally formed with one another by using synthetic resin. Further, projections protruding from a surface of the housing in a direction nearly orthogonal to a direction, in which the slider is pushed into the housing, alternatively, concave portions recessed from the surface of the housing can latch the latching portions. Incidentally, it is necessary that an insertion portion opened in the direction, in which the flat wiring member is inserted, and in the direction, into which the slider is pushed, is formed in the housing. Moreover, it is necessary to draw a forming mold in this direction. Thus, in the case that the concave portions recessed from the surface of the housing are employed as the latching portions. However, in such a case, the mold should be drawn in a direction (that is, a direction in which the concave portions are opened) differing from the direction in which the mold is divided. Consequently, mold equipment becomes complex for that. In contrast, in the case that projections protruding from a surface of the housing in a direction nearly orthogonal to a direction, in which the slider is pushed into the housings are employed as the latching portions, the mold is divided into molding parts in the direction, in which the flat wiring member is inserted, by using the projections as the boundaries. The forming of the latching portions is enabled by drawing out all the molding parts. Thus, necessary mold equipment becomes simple.

BRIEF DESCRIPTION OF THE DRAWINGS

FIG. 1 is an exploded perspective view of a connector in accordance with an embodiment of the invention;

FIG. 2 is a cross-sectional perspective view of the connector;

[FIG. 3]

[FIG. 4]

[FIG. 5]

[FIG. 6]

FIG. 7 is an exploded perspective view illustrating a connector in accordance with a second embodiment of the invention;

FIG. 8 is a front elevational view illustrating a state in which the slider in the connector shown in FIG. 7 has been completely pulled out;

FIG. 9 is a front elevational view illustrating a state at a time when the slider of the connector shown in FIG. 7 starts to slide in a first direction;

FIG. 10 is a front elevational view illustrating a state at a time when the slider of the connector shown in FIG. 7 has completed sliding in the first direction; and

FIG. 11 is a front elevational view illustrating a state at a time when the slider of the connector shown in FIG. 7 has completed sliding.

FIG. 12 is an exploded perspective view of a connector in accordance with an embodiment of the invention;

FIG. 13 is a cross-sectional perspective view of the connector;

[FIG. 14]

[FIG. 16]

[FIG. 17]

FIG. 18 is a perspective view illustrating an example of a connector for connecting a terminal of a flexible wiring member to a circuit board; and

[FIG. 19]

FIG. 20 is an exploded perspective view illustrating a connector according to an embodiment of the invention.

FIG. 21 is a sectional perspective view illustrating the connector.

[FIG. 22]

[FIG. 23]

[FIG. 24]

[FIG. 25]

FIG. 26 is a sectional perspective view illustrating the connector.

[FIG. 27]

[FIG. 28]

FIG. 29 is an exploded perspective view illustrating a connector according to another embodiment of the invention.

DETAILED DESCRIPTION OF THE PREFERRED EMBODIMENTS

[Mode for Carrying Out the Invention]

(First Embodiment)

Figure 1:
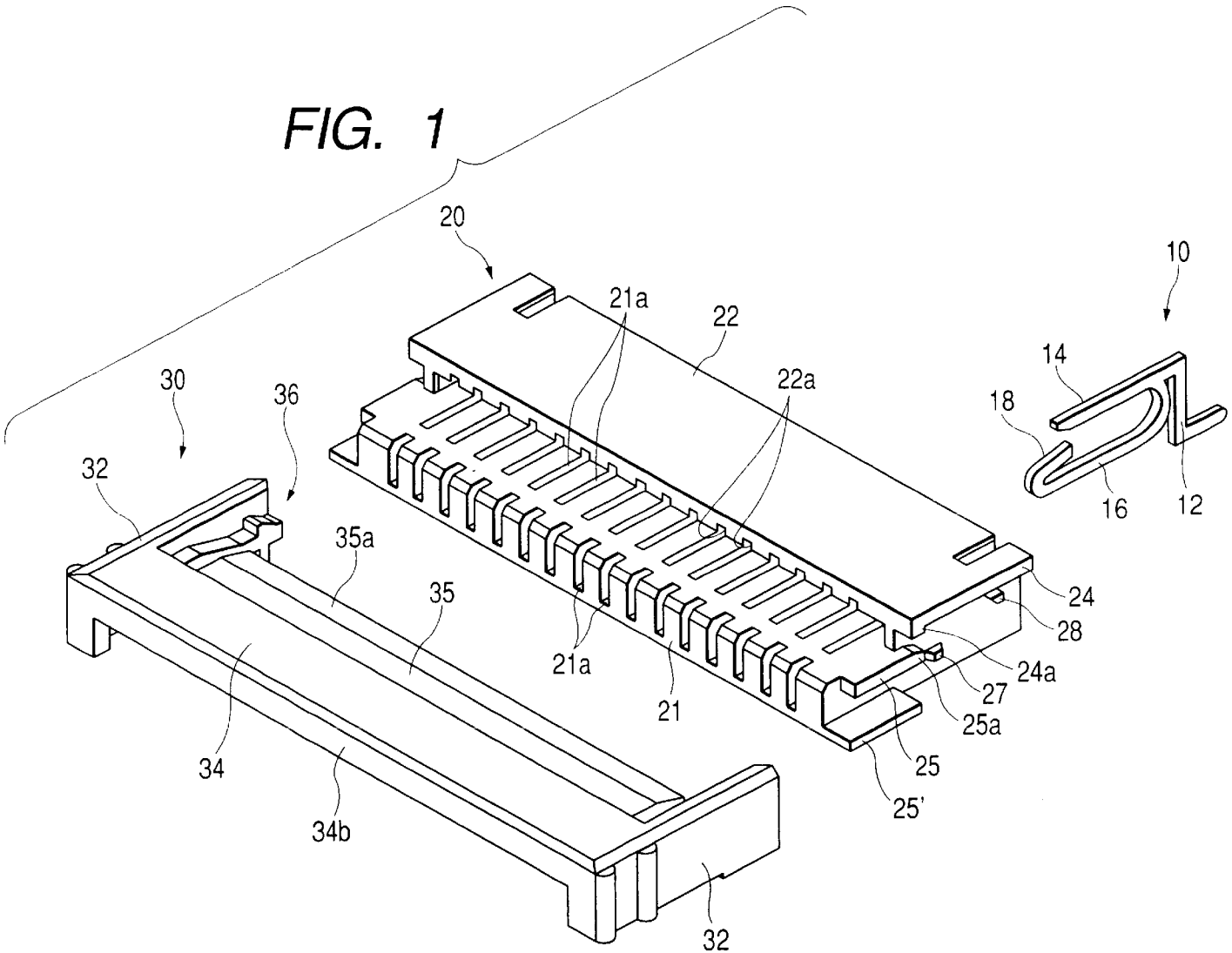
[FIG. 1]
Figure 2:
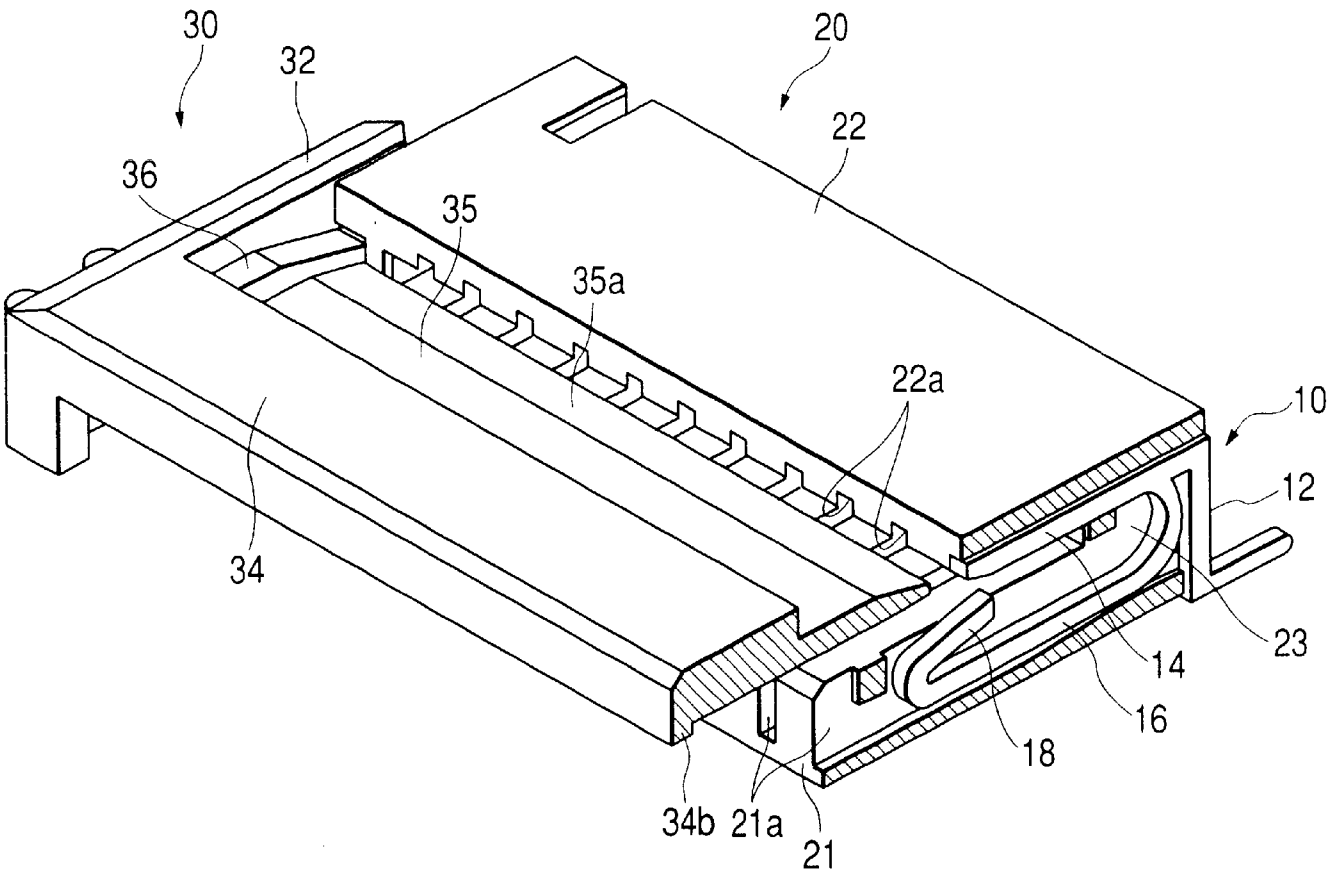
[FIG. 2]

Referring now to FIGS. 1 to 6B, a description will be given of a first embodiment of the invention.

The illustrated connector has a multiplicity of terminals 10, a housing 20 for supporting them, and a slider 30 fitted to the housing 20.

Each terminal 10 integrally comprises a substantially L-shaped leg portion 12 formed of a conductive material such as a metal and mounted on a substrate; an upper horizontal portion 14 extending horizontally from an upper end of this leg portion 12; a lower horizontal portion 16 branched off downwardly from a proximal end of this upper horizontal portion 14 and extending parallel to the upper horizontal portion 14; and a conductor contacting portion 18 which reverses from an end of this lower horizontal portion 16 at an acute angle. A lower surface of a front terminal of the upper horizontal portion 14 is formed as an inclined surface which is oriented in such a manner as to become higher toward the front.

The overall housing 20 is integrally formed of an insulating material such as a synthetic resin. Specifically, the housing 20 has a main body portion 21 extending in the left-and-right direction and a top wall portion 22 extending parallel to the main body portion 21 on top of a rear half portion of the main body portion 21. The main body portion 21 and the top wall portion 22 are integrally connected to each other via a connecting portion 23 and left and right side walls of a rear portion of the housing.

Terminal accommodating slots 21*a* extending in the back-and-forth direction are formed in the main body portion 21 to accommodate the lower horizontal portions 16 of the terminals 10, respectively. The terminals 10 are fixed in these terminal accommodating slots 21*a,* and their conductor contacting portions 18 are set in a state of projecting upward from the terminal accommodating slots 21*a*. Meanwhile, terminal fitting slots 22*a* extending in the back-and-forth direction are formed in a lower surface of the top wall portion 22 to allow the upper horizontal portions 14 of the terminals 10 to be fitted therein.

Left and right terminals of the top wall portion 22 are formed as protrusions 24 protruding from the left and right side surfaces of the housing 20 to the outside and extending in the back-and-forth direction. A projection 24*a* projecting downward is formed at a front terminal of each protrusion 24. This projection 24*a* serves as both a restraining portion and a stopper in the invention, and a tapered surface which is oriented such that the amount of its projection increases toward the rear (toward the right-hand side in FIG. 3A) is formed at a front side portion of the projection 24*a*.

Similarly, a pair of upper and lower protrusions 25 and 25' extending in the back-and-forth direction are formed on a front portion of each of left and right sides surfaces of the main body portion 22. The rear terminal (the right terminal in FIG. 3A) 25*a* of the protrusion 25, together with the projection 24*a,* constitutes a restraining portion in the invention, and a tapered surface 25*b* oriented in such a manner as to be lower toward the rear is formed at that rear terminal 25*a*.

The slider 30 is integrally formed of an insulating material in the same way as the housing 20. Specifically, the slider 30 integrally has a pair of left and right side walls 32 extending in the back-and-forth direction and a connecting portion 34 for connecting the side walls 32 in the left-and-right direction, and the interval between the side walls 32 is set to be substantially identical to the dimension in the left-and-right direction of the housing 20. At a rear end surface of the connecting portion 34, a wiring-member holding piece 35 extends rearwardly from a portion excluding the left and right terminals, and a tapered surface 35*a* oriented in such a manner as to be lower toward the rear is formed on an upper surface of a rear terminal of this wiring-member holding piece 35.

A guide portion 36 which is an inwardly protruding protrusion is formed on an inner side surface of each of the side walls 32. This guide portion 36 has in a continuous manner a lower horizontal portion 36*a* extending in the horizontal direction, an inclined portion 36*b* (a first guide portion) extending diagonally upward from a front end of the lower horizontal portion 36*a* toward the front side, and an upper horizontal portion (a second guide portion) 36*c* extending horizontally from a front end of the inclined portion 36*b* toward the front side, these portions being arranged in that order from a rear end (right end in FIG. 3A) of the guide portion 36. Each of these portions has a thickness allowing each of them to be fitted between the projection 24*a* of the housing 20 and the rear terminal 25*a* of the protrusion 25 substantially without a gap. Namely, the guide portion 36 has such a thickness (i.e., a vertical dimension) that the guide portion 36 is restrained from upper and lower directions by the projection 24*a* of the housing 20 and the rear terminal 25*a* of the protrusion 25 while its sliding in the longitudinal direction is allowed.

The shape of each guide portion 36 is set so as to guide the slider 30 so that the slider 30 undergoes particular movement when the slider 30 is pushed in, and its specific movement will be described later.

An upwardly projecting portion to be retained 36*d* is formed on an upper surface of the lower horizontal portion 36*a* of the guide portion 36. The arrangement provided is such that as the portion to be retained 36*d* abuts against the projection 24*a,* the slider 30 is prevented from coming off the housing 20 in the forward direction. Further, a vertical portion 36*e* extends downward from an appropriate portion of the lower horizontal portion 36*a*.

Figure 3A:
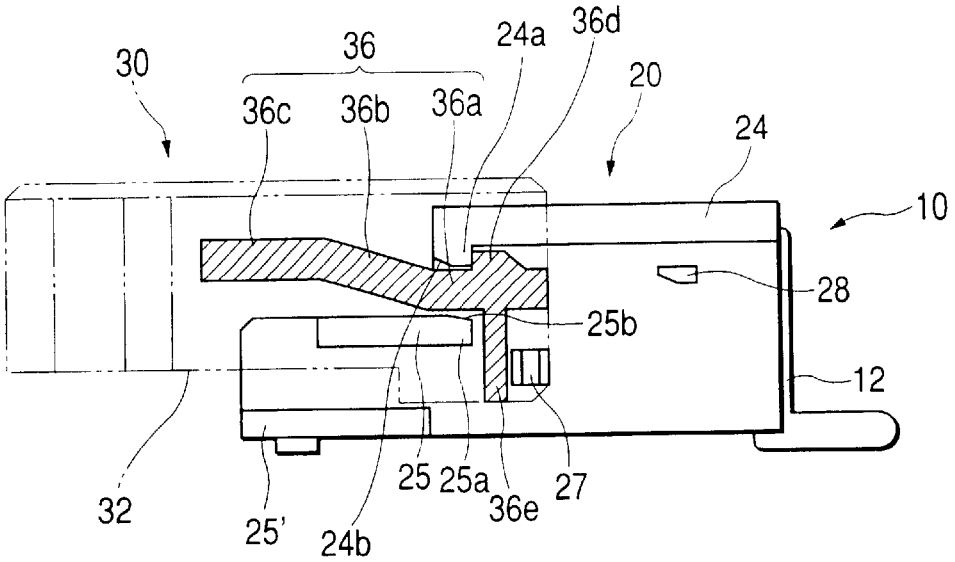
FIGS. 3A and 3B are cross-sectional front elevational views illustrating a state in which a slider of the connector has been completely pulled out.

Meanwhile, a projection 27 is formed on each side surface of the housing 20 at a position adjacent to the rear side of the vertical portion 36*e* in a state in which the slider 30 has been completely pulled out (in the state shown in FIG. 3A). As the projection 27 and the vertical portion 36*e* abut against each other, the careless movement of the slider 30 in its pushing-in direction (in the rightward direction in FIG. 3A) is restrained (i.e., is tentatively retained). In addition, a retaining projection (retaining portion) 28 for engaging the projection 36*d* in a state in which the slider 30 has been completely pushed in (in the state shown in FIG. 6A) is formed on each side surface of the housing 20. The arrangement provided is such that the backward movement of the slider 30 in its pulling-out direction is restrained (i.e., is finally retained) by that engagement.

At a terminal of a flexible wiring member 40 which is inserted in the housing 20, an insulating layer on its lower surface side is peeled off to set inner conductors in an exposed state, while a reinforcing plate 42 is fixed to an upper surface of the terminal by a means such as bonding. In this embodiment, the reinforcing plate 42 has a thickness substantially equivalent to that of the main body of the flexible wiring member 40 (e.g., 0.2 mm or thereabouts).

In contrast, a projecting portion 34*b* projecting downward with an amount of projection substantially equivalent to that of the aforementioned reinforcing plate 42 is formed on a lower surface of a front end of the connecting portion 34 of the slider 30. The arrangement provided is such that the forward movement of the flexible wiring member 40 with respect to the slider 30 is restrained by the abutment of the projecting portion 34*b* against the reinforcing plate 42.

Figure 6A:
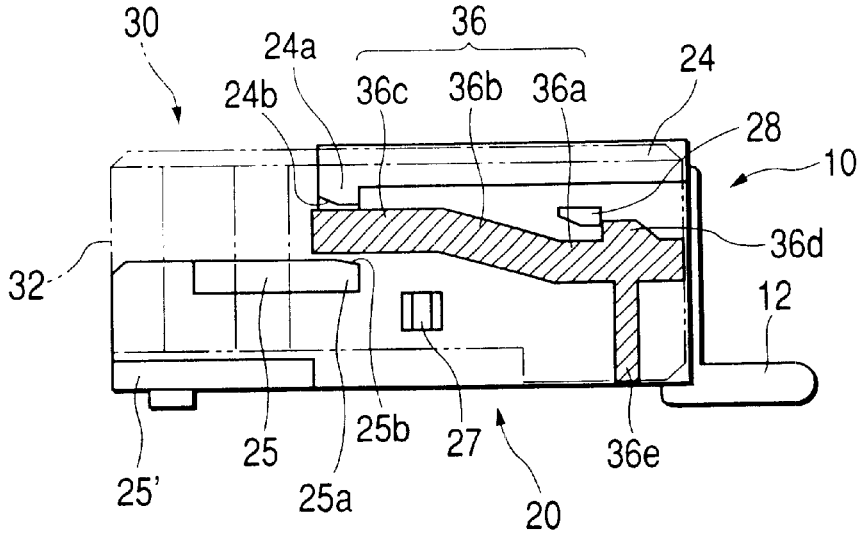
FIGS. 6A and 6B are cross-sectional front elevational views illustrating a state at a point of time when the slider of the connector has completed sliding.
Figure 6B:
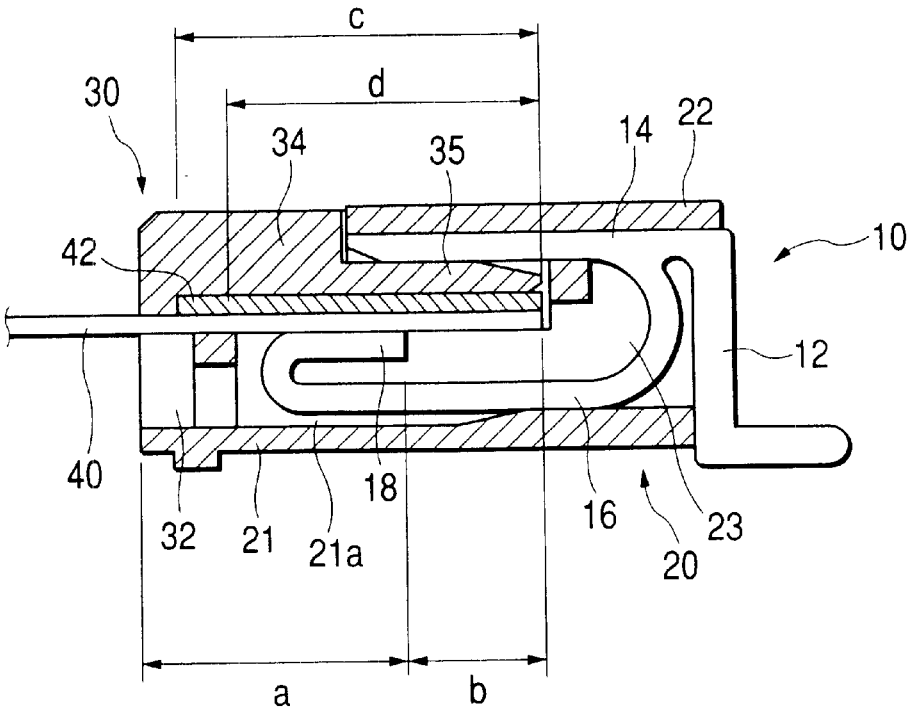

Various dimensions in the back-and-forth direction of this connector are set as shown in FIG. 6B. Namely, if it is assumed that, as shown in the drawing, the distance from the front end (the left end in the drawing) of the slider 30 to a rear end of the conductor contacting portion 18 is a, that the distance from the rear end of the conductor contacting portion 18 to an insertion end of the flexible wiring member 40 is b, that the dimension, in the wiring-member inserting direction, of the reinforcing plate 42 fixed to the flexible wiring member 40 is c, and that the dimension, in the wiring-member inserting direction, of the region in the terminal of the flexible wiring member where the insulating layer on its lower surface side has been peeled off (i.e., the region where the conductor is exposed on the lower side) is d, the respective dimensions are set so as to satisfy the relationship of $b<d<c<(A+b)$.

Next, a description will be given of the operation of this connector.

First, as shown in FIG. 3A, the slider 30 is set in a state in which it is completely pulled out toward this side from the housing 20. At this time, as the projection 36*d* formed on each guide portion 36 of the slider 30 abuts from the rear against the projection 24*a* formed on the protrusion 24 on the housing 20 side, the slider 30 is prevented from coming off the housing 20 (tentatively retained state).

In this state, the terminal of the flexible wiring member 40 is inserted into a space between the upper horizontal portion 14 and the conductor contacting portion 18 of the terminal 10 in side the housing 20 from the lower sides of the connecting portion 34 and the wiring-member holding piece 35 of the slider 30.

This insertion is ideally effected deeply up to the position where an inserting end of the flexible wiring member 40 abuts against an innermost end of the housing 20, i.e., a front end 23*a* (FIG. 3B) of the connecting portion 23, or up to a position close to it. However, with the illustrated connector, since the downwardly-oriented projecting portion 34*b* formed on a front terminal of the slider 30 has the function of pushing in the reinforcing plate 42 of the flexible wiring member 40 from this side toward the innermost part, even if the insertion of the flexible wiring member 40 is quite shallow as shown in FIG. 3B, the flexible wiring member 40 can be finally inserted up to a proper connecting position (in the invention, however, this projecting portion 34*b* may be omitted, as required).

Figure 3B:
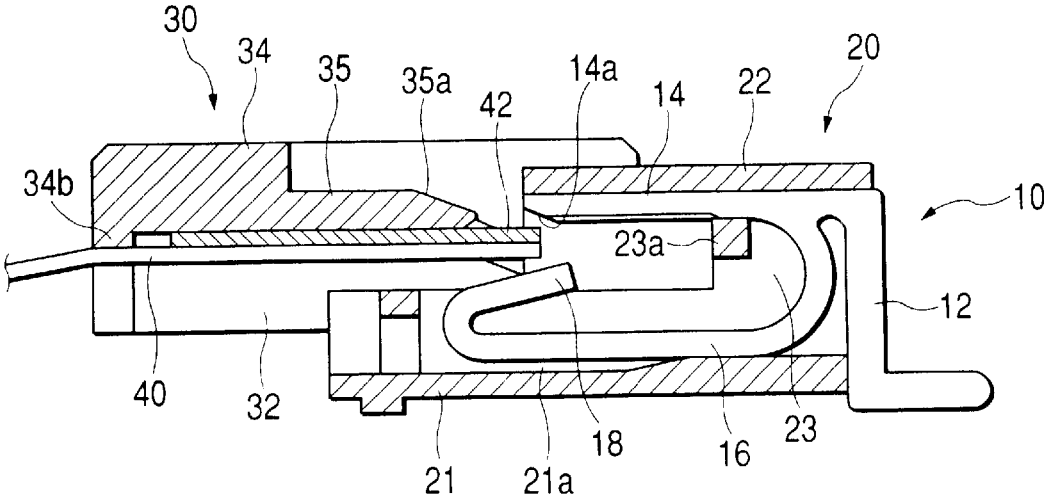
Figure 4A:
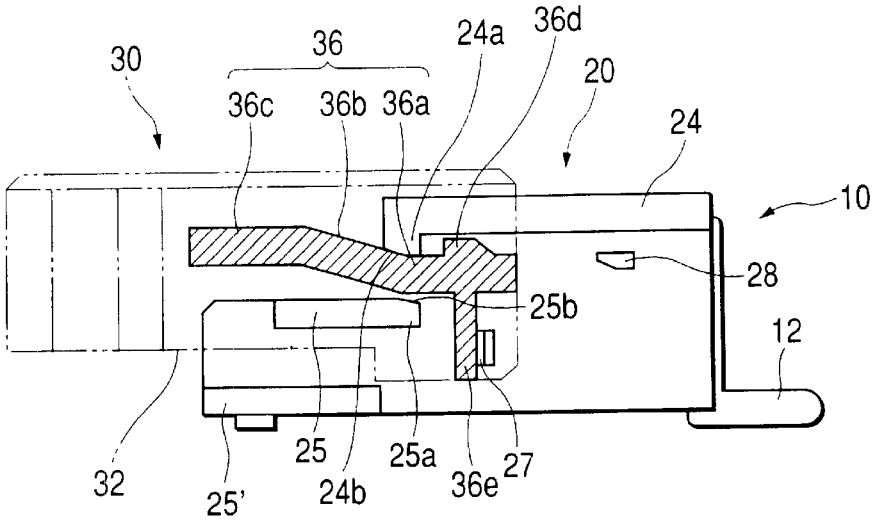
FIGS. 4A and 4B are cross-sectional front elevational views illustrating a state at a point of time when the slider of the connector starts to slide in a first direction.
Figure 4B:
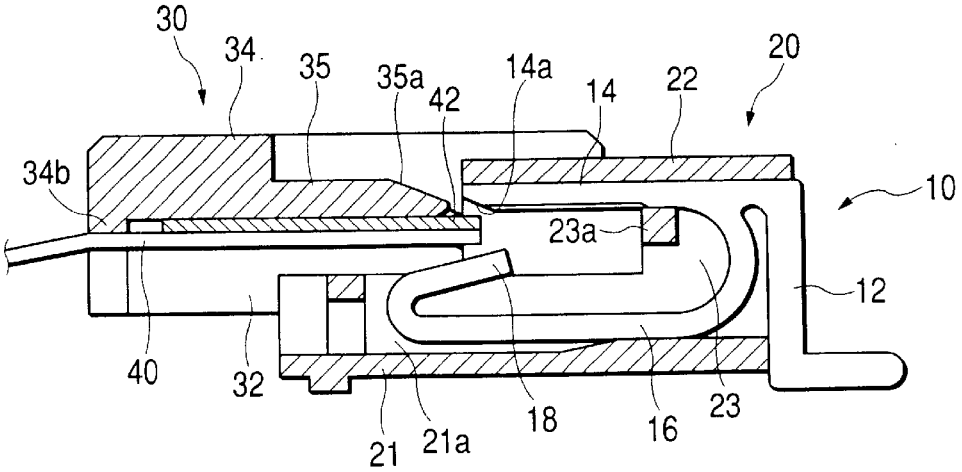

Meanwhile, at both side walls 32 of the slider 30, although each of their guide portions 36 is restrained from upper and lower directions by the projection 24*a* and the rear terminal of the protrusion 25 on the housing 20 side, in the state in which the slider has been pulled out as shown in FIGS. 3A and 3B, since the lower horizontal portion 36*a* which is lowest in the guide portion 36 is restrained as described above, the slider 30 is held at the highest position relative to the housing 20. Accordingly, the insertion gap on the lower side of the slider 30 is large, so that the flexible wiring member 40 can be easily inserted into the housing 20 through that gap.

After the insertion of the flexible wiring member 40, the slider 30 is pushed in toward a rear end side of the housing 20 while causing the vertical portion 36*e* of the slider 30 to ride over the projection 27. In conjunction with this pushing in, the portion of the guide portion 36 which is restrained by the projection 24*a* and the rear terminal of the protrusion 25 gradually changes. However, when the inclined portion (first guide portion) 36*b* has come to that restraining position (FIG. 4A), the slider 30 starts to slide diagonally downward at an angle equal to its angle of inclination. Namely, the slider 30 slides in a first direction which is inclined in the direction of approaching the conductor contacting portion 18 of the terminal 10 (diagonally downwardly oriented) with respect to the inserting direction of the flexible wiring member (the horizontal direction in the drawing).

Figure 5A:
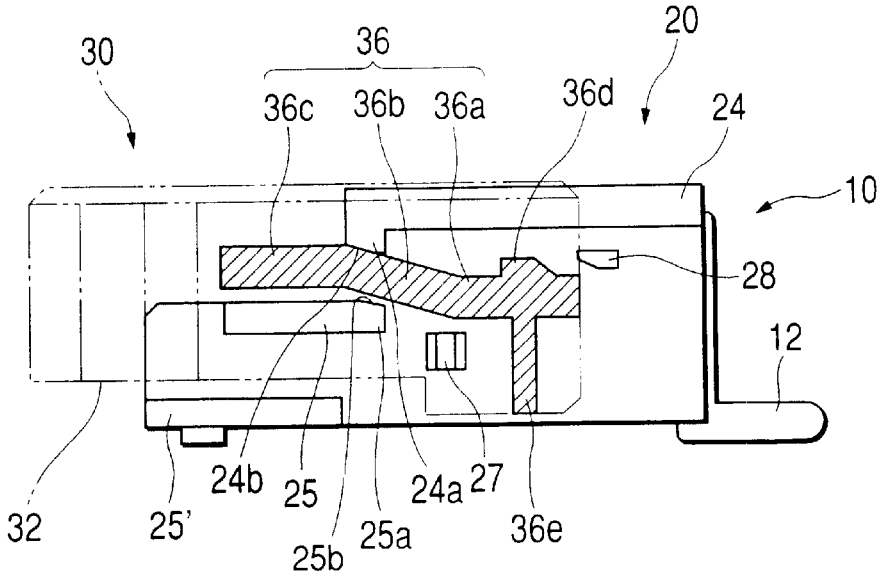
FIGS. 5A and 5B are cross-sectional front elevational views illustrating a state at a point of time when the slider of the connector has completed sliding in the first direction.
Figure 5B:
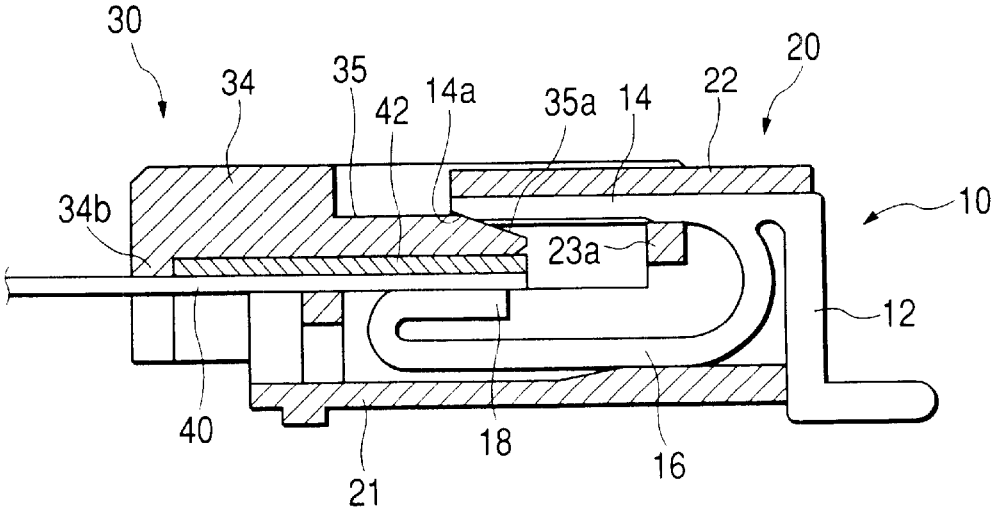

As a result of this diagonal sliding, as shown in FIG. 5B, the wiring-member holding piece 35 of the slider 30 slips onto the lower side of the upper horizontal portion 14 of the terminal 10, and presses the terminal of the flexible wiring member 40 against the conductor contacting portions 18 of the terminals 10. As a result, the conductor-exposed portion of the terminal of the flexible wiring member is brought into pressure contact with each conductor contacting portion 18, thereby allowing the two parts to be electrically connected to each other.

Namely, with this connector, by providing an area for allowing the slider 30 to slide diagonally, the flexible wiring member 40 can be pressed against the conductor contacting portions 18 of the terminals 10 in conjunction with the pushing in of the slider 30 while securing a wide opening for insertion of the flexible wiring member 40 in the state in which the slider 30 has been pulled out.

Further, when the upper horizontal portion (second guide portion) 36*c* of the guide portion 36 starts to be restrained, as shown in FIG. 5A, the slider 30 slides in a second direction parallel to the inserting direction of the flexible wiring member 40. Then, when the slider 30 has been pushed into a predetermined depth, the portion to be retained 36*d* rides over (i.e., finally retained by) the retaining projection 28 on the housing 20 side, as shown in FIG. 6A thereby restraining the backward movement of the slider 30 and maintaining a completely joined state.

Here, in a case where there is no sliding in the second direction parallel to the inserting direction of the wiring member, which is the final sliding, i.e., in a case where the slider slides in the diagonal direction as in the conventional manner, since variations occur in the force for pressing the flexible wiring member against the terminals depending on the final pushing-in depth of the slider 30, it is difficult to stably secure the pressure contact force between the flexible wiring member and the terminals. Particularly in the case where the retaining projection 28 is provided for preventing the backward movement of the slider 30 as in the illustrated case, there is a drawback in that the aforementioned pressure contact force varies substantially due to the variation of the retaining position. However, if an arrangement is provided such that, as in this embodiment, after the slider 30 slid in the first direction inclined with respect to the inserting direction of the wiring member, the slider 30 is slid in the second direction parallel to the inserting direction of the wiring member, it is possible to stably maintain the state of pressure contact between the flexible wiring member 40 and the conductor contacting portions 18 of the terminals 10 by that sliding stroke in the second direction. In addition, even if there is a slight offset in the position of retaining by the retaining projection 28, it is possible to stably maintain the pressure contact force Further, in this embodiment, by making use of the fact that the guide portion 36 is a protrusion, the portion to be retained 36*d* is integrally formed thereon in order to effect the retention of the slider 30 (FIG. 6A) and the prevention of the slider 30 in the pulling-out direction (FIG. 3A) in the pushing-in completed states. Therefore, it is possible to add the retaining function and the coming-off preventing function with a simple structure.

(Second Embodiment)

Figure 7:
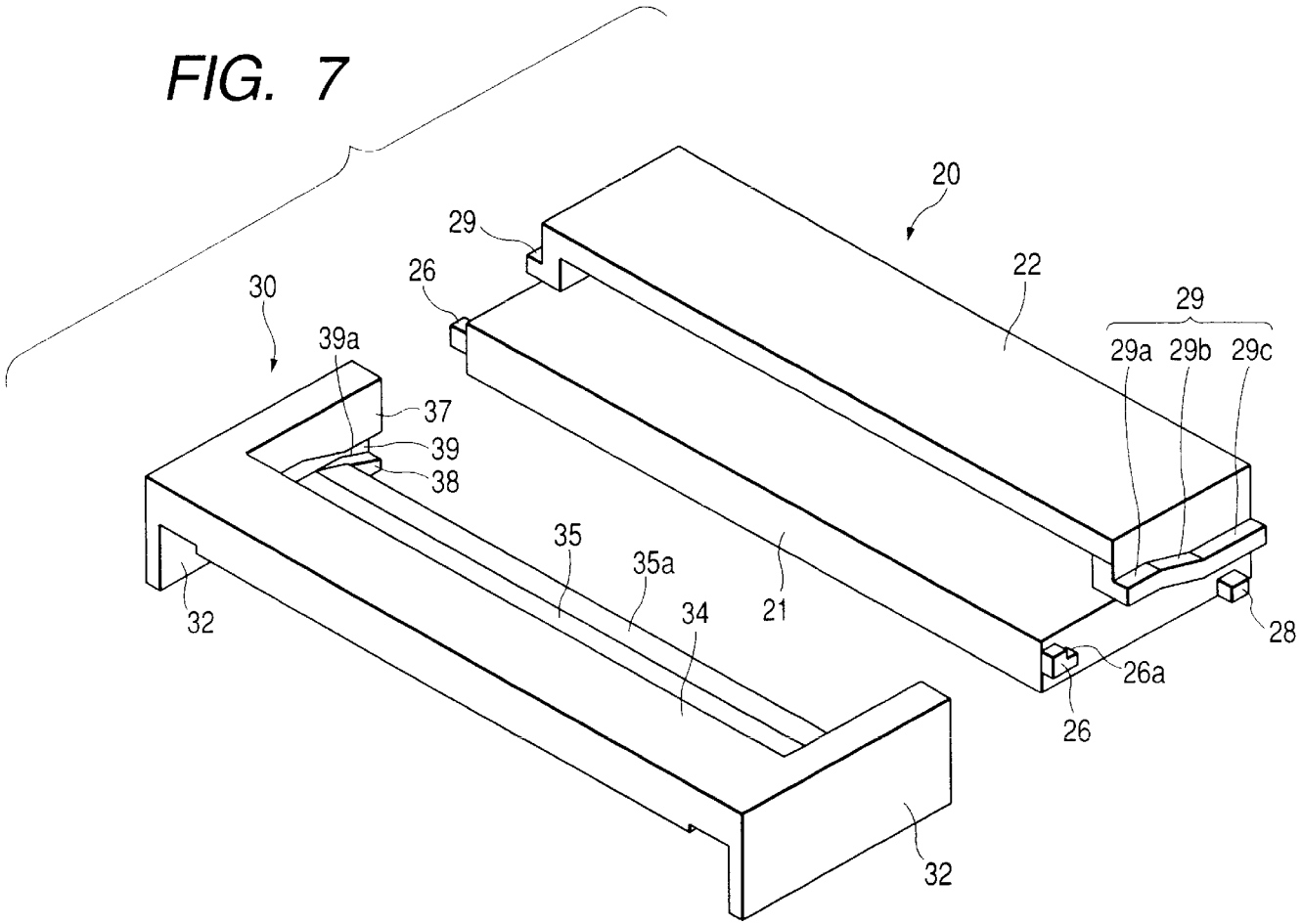
[FIG. 7]

It should be noted, however, that the guide portion 36 in the invention may not necessarily be a protrusion, and may be formed as a groove, and a projection for fitting in this groove may be provided on the housing 20 side as a restraining portion. In addition, similar sliding action can be also obtained by providing a guide portion corresponding to the guide portion 36 on the housing 20 side and by providing a restraining portion for restraining it on the slider 30 side. An example of it will be shown in FIGS. 7 to 9 as a second embodiment.

In the drawings, a pair of guide portions 29 which are protrusions are respectively formed on both side surfaces of the housing 20, and each of the guide portions 29 has in a continuous manner an upper horizontal portion 29*a,* an inclined portion (first guide portion) 29*b,* and a lower horizontal portion (second guide portion) 29*c,* these portions being arranged in that order from the front end side of the housing. Further, a pair of stoppers 26 projecting laterally are respectively formed at front ends of both side surfaces of the housing 20, and a recessed stepped portion 26*a* is formed on top of a rear end of each of the stoppers 26. In addition, a retaining projection 28 is formed at a lower end of a rear portion of either side surface of the housing.

In contrast, an upper projecting portion 37 and a lower projecting portion 38 are formed on an inner side surface of each of the side walls 32 of the slider 30 opposing the respective side surfaces of the housing. A sliding passage 39 for the guide portion 29 is formed between the two projecting portions 37 and 38.

The upper protruding portion 37 is formed over the substantially entire area of an upper half portion of the inner side surface of the side wall, and an inclined surface 37*a* corresponding to the inclination of the inclined portion 29*b* of the guide portion 29 is formed on an intermediate portion of its lower surface. The lower horizontal portion 38 is formed on a lower portion of the rear half side of the slider 30, and extends horizontally in the back-and-forth direction. Further, an inclined surface 38*a* corresponding to the inclination of the inclined portion 29*b* is formed on an upper surface of a rear terminal of the lower horizontal portion 38, and the position of a front end of the inclined surface 38*a* and the position of a rear end of the inclined surface 37*a* oppose to each other vertically. This opposing portion is the narrowest portion in the sliding passage 39, and is formed as a restraining portion 39*e* for restraining the guide portion 29 from upper and lower directions.

In addition, a projection to be retained 33 for riding over the retaining projection 28 at the pushing-in completed position (i.e., for being retained) is provided on a lower portion of the inner surface of each of the left and right side walls 32 at the rear end of the slider 30.

Figure 8:
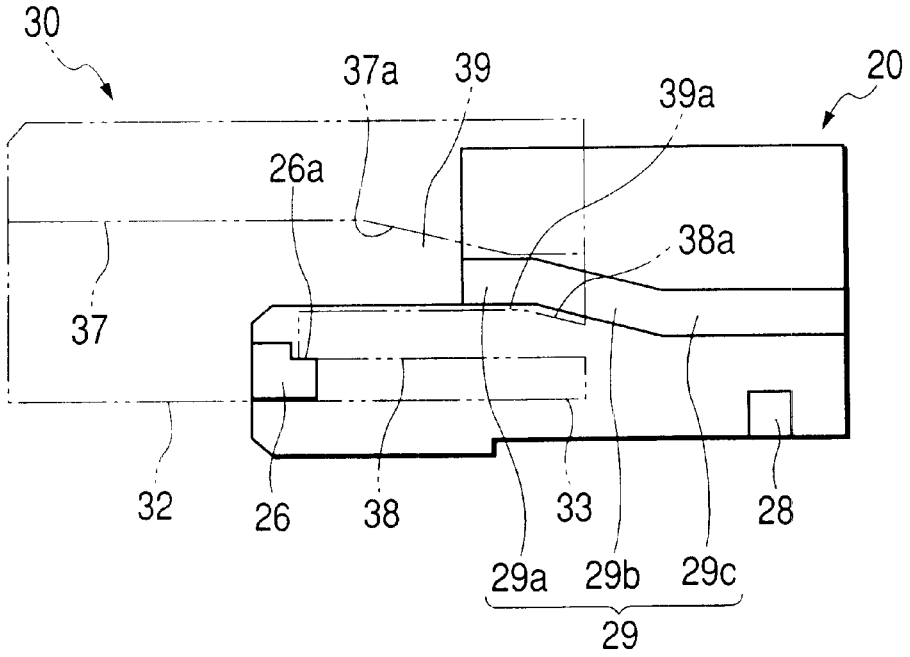
[FIG. 8]
Figure 9:
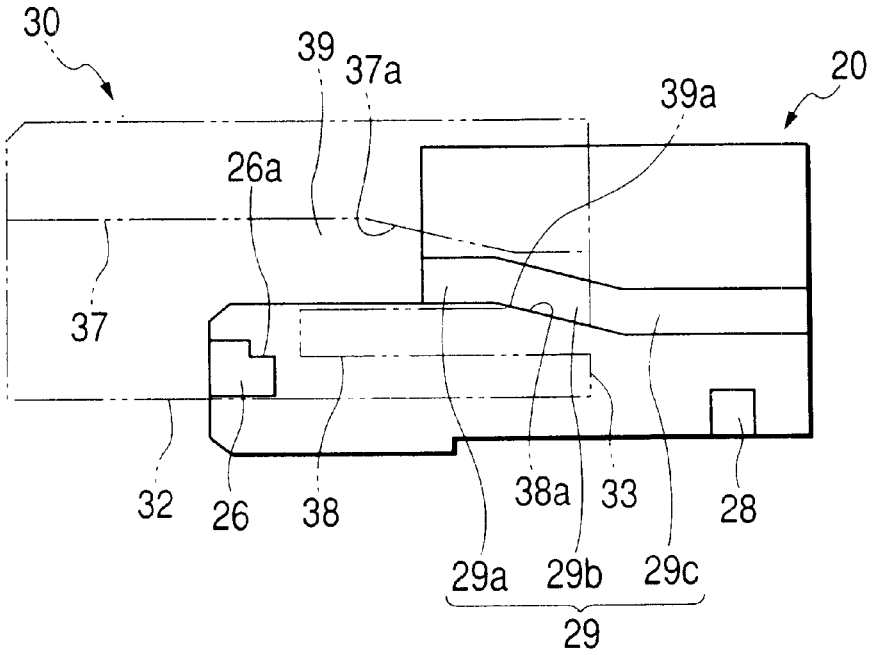
[FIG. 9]

With this connector, in the state in which the slider 30 has been completely pulled out of the housing 20 toward this side as shown in FIG. 8, since the restraining portions of the slider 30 restrain the upper horizontal direction 29*a* which is the highest in the guide portion 29 of the housing 20, the slider 30 is held at the highest position. Accordingly, in the same way as the first embodiment, the terminal of the flexible wiring member can be easily inserted into the housing 20 from the lower side of the slider 30. In addition, as the front terminal of the lower projecting portion 38 in the slider 30 engages the stepped portion 26*a* of the stopper 26 on the housing 20 side, the slider 30 can be prevented from coming off the housing 20 in the pulling-out direction.

When the slider 30 is pushed into the housing 20 after the insertion of the flexible wiring member, the portion where the restraining portion 39*a* restrains the guide portion 29 gradually changes, and when the inclined portion (first guide portion) starts to be restrained (FIG. 9), the slider 30 starts to slide diagonally downward at an angle equal to its angle of inclination. As a result, as shown in FIG. 5B, the wiring-member holding piece 35 of the slider 30 slips onto the lower side of the upper horizontal portions 14 of the terminals 10, and presses the terminal of the flexible wiring member 40 against the conductor contacting portions 18 of the terminals 10.

Figure 10:
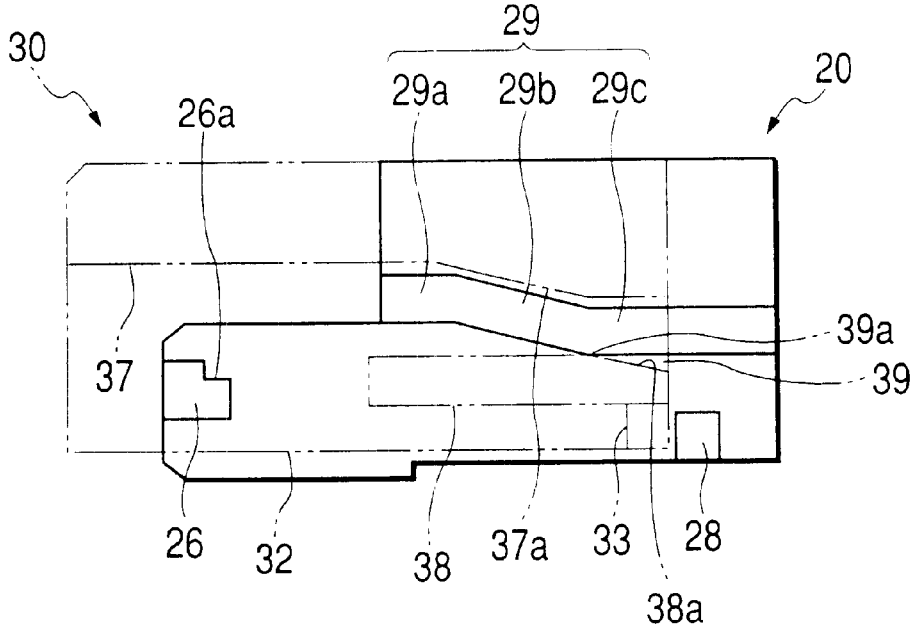
[FIG. 10]
Figure 11:
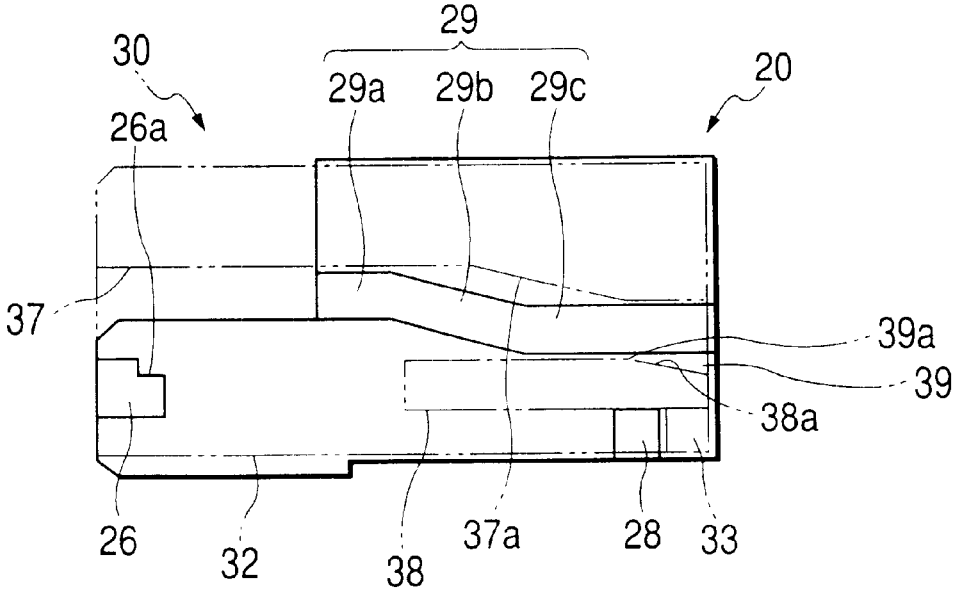
[FIG. 11]
Figure 12:
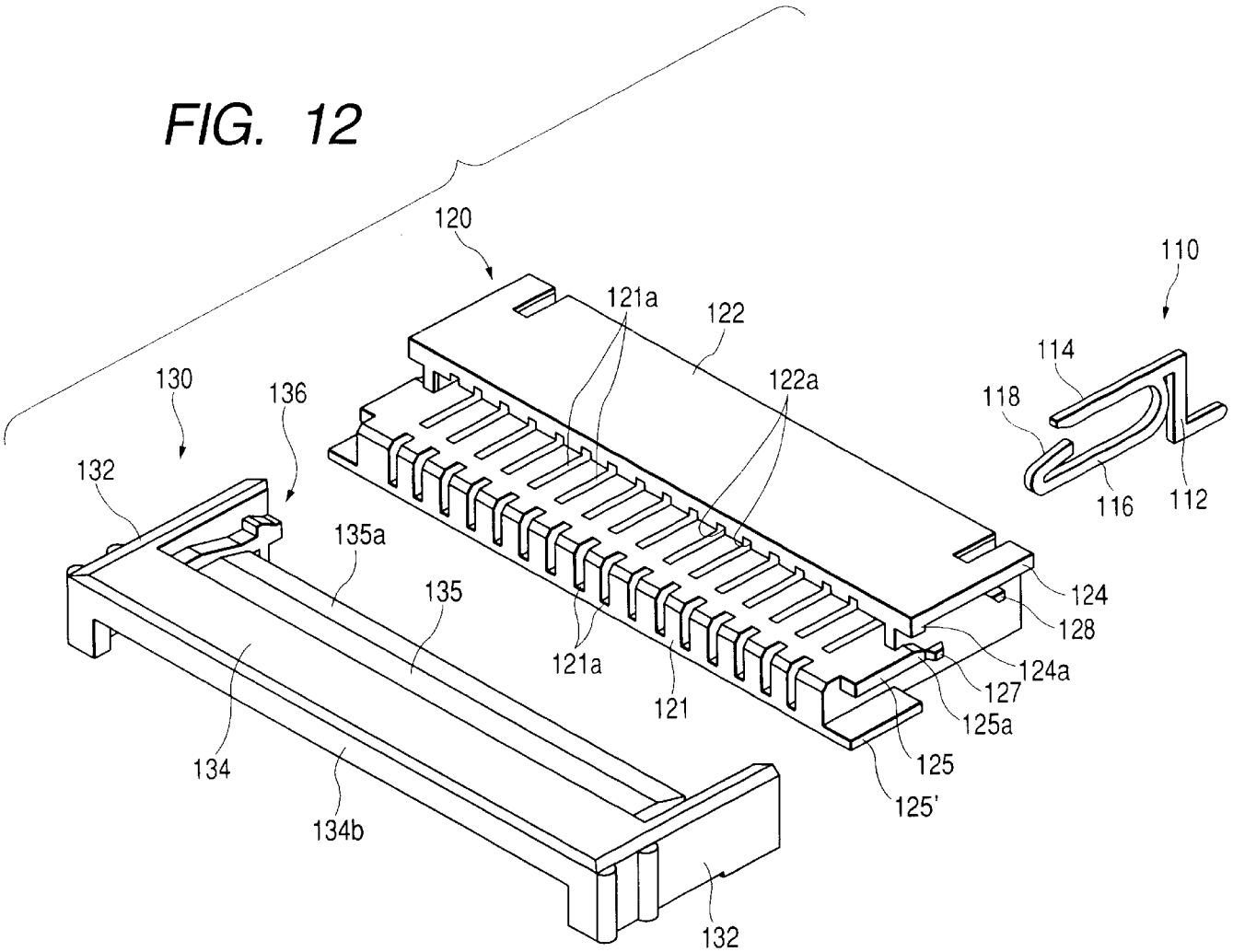
[FIG. 12]
Figure 13:
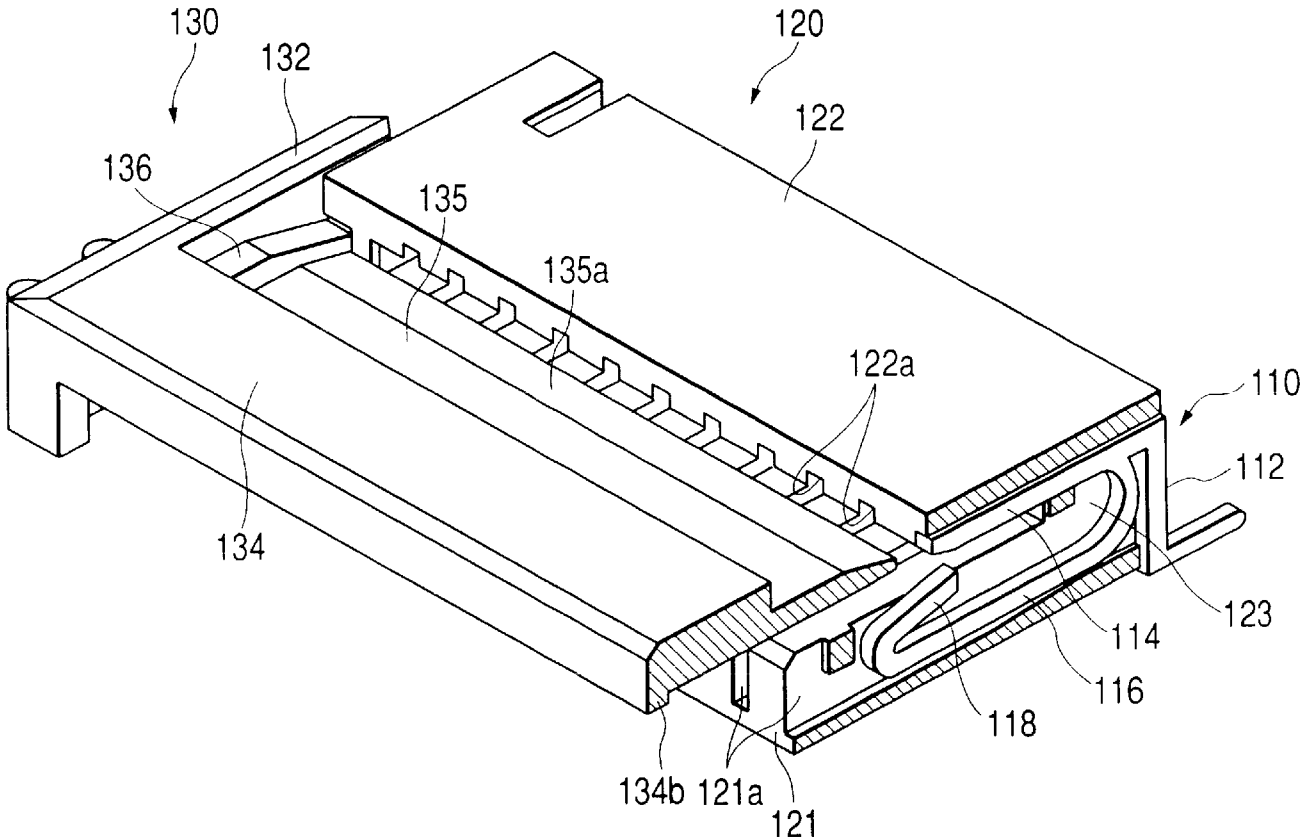
[FIG. 13]

Furthermore, when the restraining portion 29 starts to restrain the lower horizontal direction (second guide portion) 29*c* (FIG. 10), the slider 30 slides in the second direction parallel to the inserting direction of the wiring member. When the sliding has progressed down to a predetermined depth, the portion to be retained 33 on the slider 30 side rides over the retaining projection 28 on the housing 20 side, thereby retaining the slider 30 on the housing 20 side and restraining the backward movement of the slider 30 (FIG. 11).

As shown in this embodiment, in the invention, even if the guide portion is provided on the housing 20 side, the slider 30 can be slid along a peculiar path. In this case as well, the guide portion may be formed not as a protrusion but as a groove, and a restraining portion for fitting in the groove may be provided projectingly on the slider 30 side.

(Other Embodiments)

In addition, in the invention, it is possible to adopt the following embodiments.

(1) In the invention, the inserting direction of the flexible wiring member 40 is not limited and, for example, the terminal of the flexible wiring member may be inserted into the housing downwardly from above. In this case as well, it suffices if a direction which is slightly inclined with respect to the inserting direction (vertical direction) is set as the first direction.

(2) Although in the above-described embodiment the connector is shown in which the terminal of the wiring member is inserted into the housing 20 from the lower side of the pulled-out slider 30, the terminal of the wiring member may be inserted from the upper side of the pulled-out slider 30. In this case, it suffices if the first direction among the sliding directions of the slider 30 is set to a diagonally upward direction. However, the inserting operation of the wiring member can be further facilitated if the terminal of the wiring material is arranged to be inserted from the lower side of the slider 30 as in the above-described embodiment, and if the position of that inserted end can be visually confirmed from the upper side.

(3) In the invention, the specific shape and structure of the flexible wiring member 40 is not limited, and the invention is also applicable to other various flat wiring members excelling in flexibility.

(4) The lower horizontal direction 36*a* shown in the above-described first embodiment and the upper horizontal direction 29*a* shown in the second embodiment, i.e., the horizontal portion on this side, may be omitted, as required. Namely, if the guide portion includes at least the first guide portion corresponding to the first direction and the second guide portion corresponding to the second direction, the slider can be made to depict the sliding path which constitutes the characteristic of the invention.

(Third Embodiment)

Referring now to FIGS. 12 to 17B, a description will be given of a preferred embodiment of the invention.

The illustrated connector has a multiplicity of terminals 110, a housing 120 for supporting them, and a slider 130 fitted to the housing 120.

Each terminal 110 integrally comprises a substantially L-shaped leg portion 112 formed of a conductive material such as a metal and mounted on a substrate; an upper horizontal portion 114 extending horizontally from an upper end of this leg portion 112; a lower horizontal portion 16 branched off downwardly from a proximal end of this upper horizontal portion 114 and extending parallel to the upper horizontal portion 114; and a conductor contacting portion 118 which reverses from an end of this lower horizontal portion 116 at an acute angle. A lower surface of a front terminal of the upper horizontal portion 114 is formed as an inclined surface which is oriented in such a manner as to become higher toward the front.

The overall housing 120 is integrally formed of an insulating material such as a synthetic resin. Specifically, the housing 120 has a main body portion 121 extending in the left-and-right direction and a top wall portion 122 extending parallel to the main body portion 121 on top of a rear half portion of the main body portion 121. The main body portion 121 and the top wall portion 122 are integrally connected to each other via a connecting portion 123 and left and right side walls of a rear portion of the housing.

Terminal accommodating slots 121*a* extending in the back-and-forth direction are formed in the main body portion 121 to accommodate the lower horizontal portions 116 of the terminals 110, respectively. The terminals 110 are fixed in these terminal accommodating slots 121*a,* and their conductor contacting portions 118 are set in a state of projecting upward from the terminal accommodating slots 121*a*. Meanwhile, terminal fitting slots 122*a* extending in the back-and-forth direction are formed in a lower surface of the top wall portion 122 to allow the upper horizontal portions 114 of the terminals 110 to be fitted therein.

Left and right terminals of the top wall portion 122 are formed as protrusions 124 protruding from the left and right side surfaces of the housing 120 to the outside and extending in the back-and-forth direction. A projection 124*a* projecting downward is formed at a front terminal of each protrusion 124. This projection 124*a* serves as both a restraining portion and a stopper in the invention, and a tapered surface which is oriented such that the amount of its projection increases toward the rear (toward the right-hand side in FIG. 14A) is formed at a front side portion of the projection 124*a*.

Similarly, a pair of upper and lower protrusions 125 and 125' extending in the back-and-forth direction are formed on a front portion of each of left and right sides surfaces of the main body portion 122. A tapered surface 125*b* oriented in such a manner as to be lower toward the rear is formed at a rear terminal (the right terminal in FIG. 14A) 125*a* of the protrusion 125.

The slider 130 is integrally formed of an insulating material in the same way as the housing 120. Specifically, the slider 130 integrally has a pair of left and right side walls 132 extending in the back-and-forth direction and a connecting portion 134 for connecting the side walls 132 in the left-and-right direction, and the interval between the side walls 132 is set to be substantially identical to the dimension in the left-and-right direction of the housing 120. At a rear end surface of the connecting portion 134, a wiring-member holding piece 135 extends rearwardly from a portion excluding the left and right terminals, and a tapered surface 135*a* oriented in such a manner as to be lower toward the rear is formed on an upper surface of a rear terminal of this wiring-member holding piece 135.

A guide portion 136 which is an inwardly protruding protrusion is formed on an inner side surface of each of the side walls 132. This guide portion 136 has in a continuous manner a lower horizontal portion 136*a* extending in the horizontal direction, an inclined portion 136*b* extending diagonally upward from a front end of the lower horizontal portion 136*a* toward the front side, and an upper horizontal portion 136*c* extending horizontally from a front end of the inclined portion 136*b* toward the front side, these portions being arranged in that order from a rear end (right end in FIG. 14A) of the guide portion 136. Each of these portions has a thickness allowing each of them to be fitted between the projection 124*a* of the housing 120 and the rear terminal 125*a* of the protrusion 125 substantially without a gap. Namely, the guide portion 136 has such a thickness (i.e., a vertical dimension) that the guide portion 136 is restrained from upper and lower directions by the projection 124*a* of the housing 120 and the rear terminal 125*a* of the protrusion 125 while its sliding in the longitudinal direction is allowed.

The shape of each guide portion 136 is set so as to guide the slider 130 so that the slider 130 undergoes particular movement when the slider 130 is pushed in, and its specific movement will be described later.

An upwardly projecting portion to be retained 136*d* is formed on an upper surface of the lower horizontal portion 136*a* of the guide portion 136. The arrangement provided is such that as the portion to be retained 136*d* abuts against the projection 124*a,* the slider 130 is prevented from coming off the housing 120 in the forward direction. Further, a vertical portion 136*e* extends downward from an appropriate portion of the lower horizontal portion 136*a*.

Figure 14A:
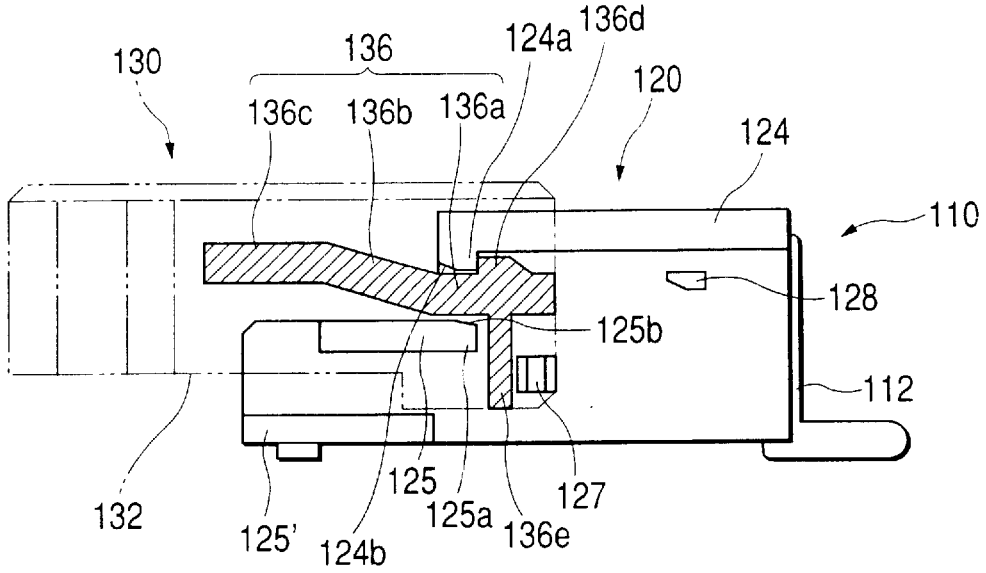
FIGS. 14A and 14B are cross-sectional front elevational views illustrating a state in which a slider of the connector has been completely pulled out.

Meanwhile, a projection 127 is formed on each side surface of the housing 120 at a position adjacent to the rear side of the vertical portion 136*e* in a state in which the slider 130 has been completely pulled out (in the state shown in FIG. 14A). As the projection 127 and the vertical portion 136*e* abut against each other, the careless movement of the slider 130 in its pushing-in direction (in the rightward direction in FIG. 14A) is restrained (i.e., is tentatively retained). In addition, a retaining projection (retaining portion) 128 for engaging the projection 136*d* in a state in which the slider 130 has been completely pushed in (in the state shown in FIG. 17A) is formed on each side surface of the housing 120. The arrangement provided is such that the backward movement of the slider 130 in its pulling-out direction is restrained (i.e., is finally retained) by that engagement.

At a terminal of a flexible wiring member 140 which is inserted in the housing 120, an insulating layer on its lower surface side is peeled off to set inner conductors in an exposed state, while a reinforcing plate 142 is fixed to an upper surface of the terminal by a means such as bonding.

It should be noted that the material and thickness of the reinforcing plate 142 can be set appropriately, and the reinforcing plate 142 in this embodiment is formed of a material (synthetic resin) equivalent to that of the main body of the flexible wiring member 140 and has a thickness (e.g., 0.2 mm or thereabouts) substantially equivalent thereto.

In contrast, a projecting portion (restraining portion) 134*b* projecting downward with an amount of projection substantially equivalent to that of the aforementioned reinforcing plate 142 is formed on a lower surface of a front end of the connecting portion 134 of the slider 130. The arrangement provided is such that as this projecting portion 134*b* abuts against the reinforcing plate 142 from the rear side in the flexible-wiring-member inserting direction (from the left-hand side in FIG. 14B), the forward movement of the flexible wiring member 140 with respect to the slider 130 (i.e., its movement in a direction opposite to the flexible-wiring-member inserting direction) is restrained.

Figure 17A:
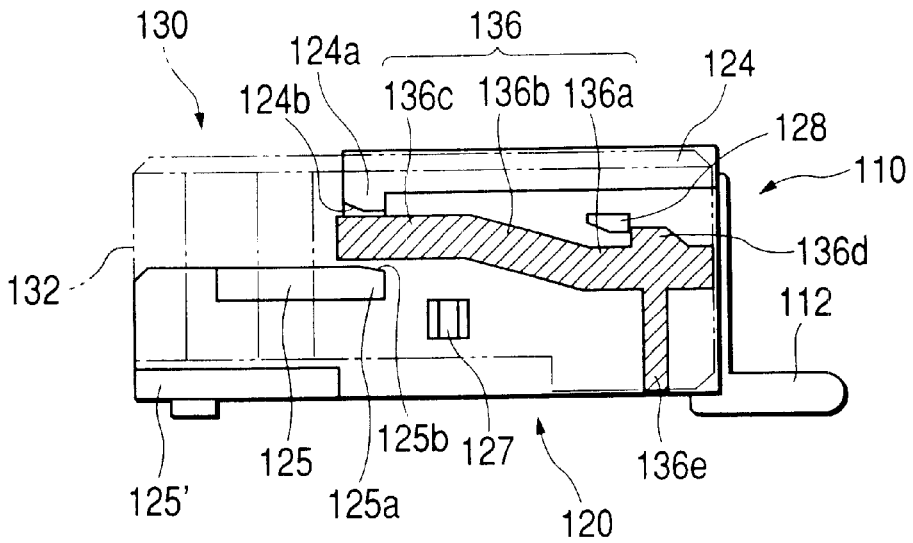
FIGS. 17A and 17B are cross-sectional front elevational views illustrating a state at a point of time when the slider of the connector has completed sliding.
Figure 17B:
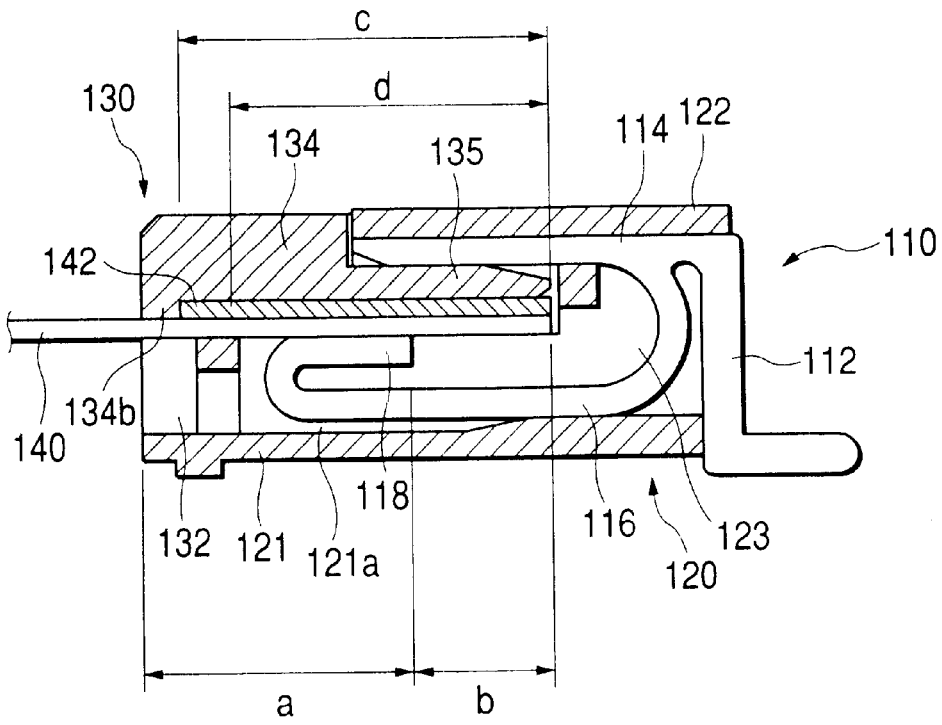
Figure 18:
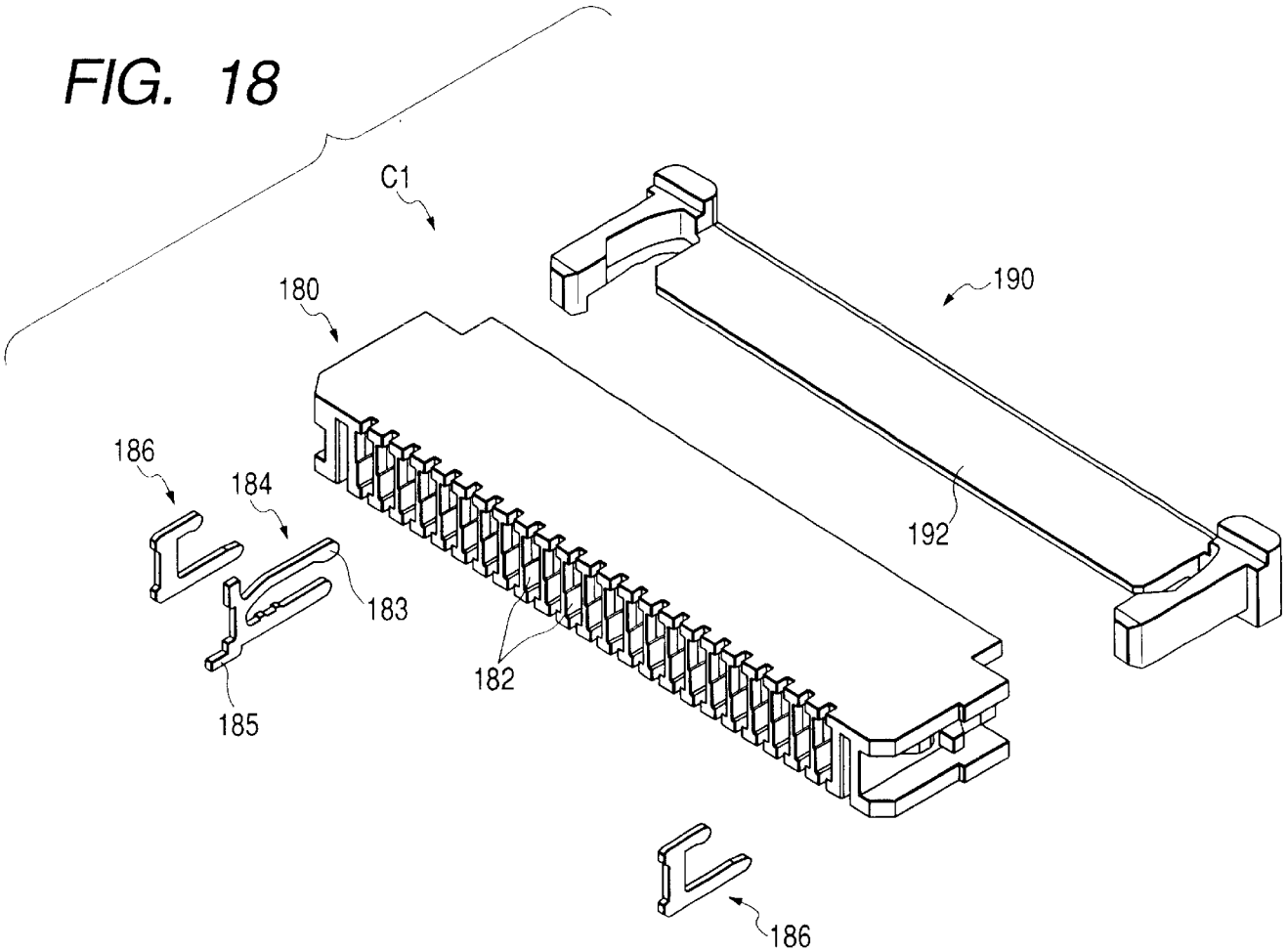
[FIG. 18]
Figure 19A:
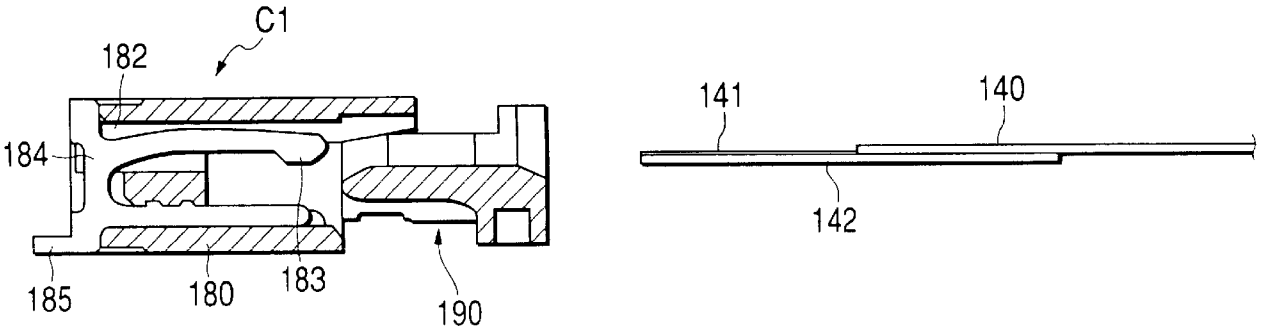
FIGS. 19A to 19C are cross-sectional views illustrating a process in which the terminal of the flexible wiring member is inserted and fixed in the connector shown in FIG. 18.
Figure 19B:
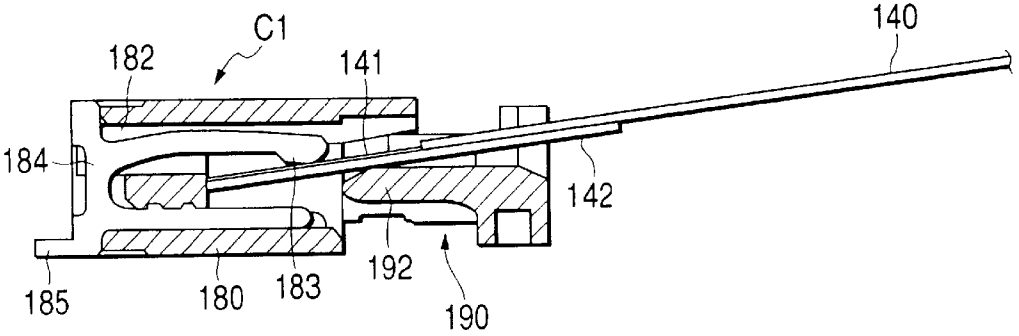
Figure 19C:
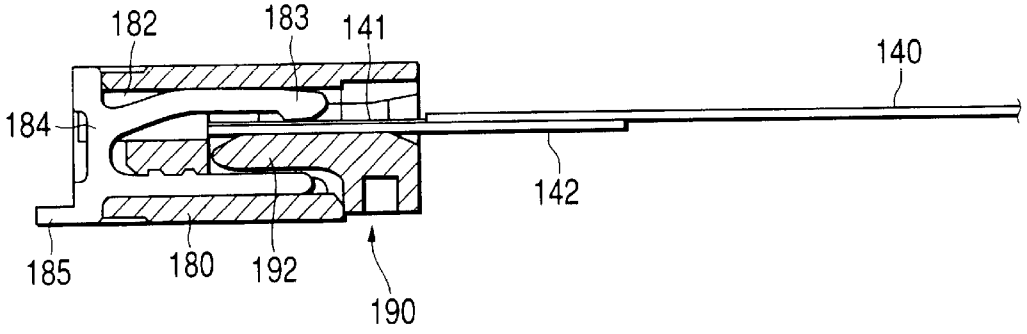

Various dimensions in the back-and-forth direction of this connector are set as shown in FIG. 17B. Namely, if it is assumed that, as shown in the drawing, the distance from the front end (the left end in the drawing) of the slider 130 to a rear end of the conductor contacting portion 110 is a, that the distance from the rear end of the conductor contacting portion 18 to an insertion end of the flexible wiring member 140 is b, that the dimension, in the wiring-member inserting direction, of the reinforcing plate 142 fixed to the flexible wiring member 140 is c, and that the dimension, in the wiring-member inserting direction, of the region in the terminal of the flexible wiring member where the insulating layer on its lower surface side has been peeled off (i.e., the region where the conductor is exposed on the lower side) is d, the respective dimensions are set so as to satisfy the relationship of b<d<c<(A+b). In short, the respective dimensions are set such that in a state in which the slider 130 has been completely pushed in and the reinforcing plate 142 is disposed in front of the projecting portion 134*b*, the conductor exposed on the reverse side of the reinforcing plate 142 is reliably brought into contact with the conductor contacting portion 118 of the terminal 110.

Next, a description will be given of the operation of this connector.

First, as shown in FIG. 14A, the slider 130 is set in a state in which it is completely pulled out toward this side from the housing 120. At this time, as the projection 136*d* formed on each guide portion 136 of the slider 130 abuts from the rear against the projection 124*a* formed on the protrusion 124 on the housing 120 side, the slider 130 is prevented from coming off the housing 120 (tentatively retained state).

In this state, the terminal of the flexible wiring member 140 is inserted into a space between the upper horizontal portion 114 and the conductor contacting portion 118 of the terminal 110 in side the housing 120 from the lower sides of the connecting portion 134 and the wiring-member holding piece 135 of the slider 130.

This insertion is ideally effected deeply up to the position where an inserting end of the flexible wiring member 140 abuts against an innermost end of the housing 120, i.e., a front end 123*a* (FIG. 14B) of the connecting portion 123, or up to a position close to it. However, with the illustrated connector, since the downwardly-oriented projecting portion 134*b* formed on a front terminal of the slider 130 has the function of pushing in the reinforcing plate 142 of the flexible wiring member 140 from this side toward the innermost part as will be described later, even if the insertion of the flexible wiring member 140 is quite shallow as shown in FIG. 14B, the flexible wiring member 140 can be finally inserted up to a proper connecting position.

Figure 14B:
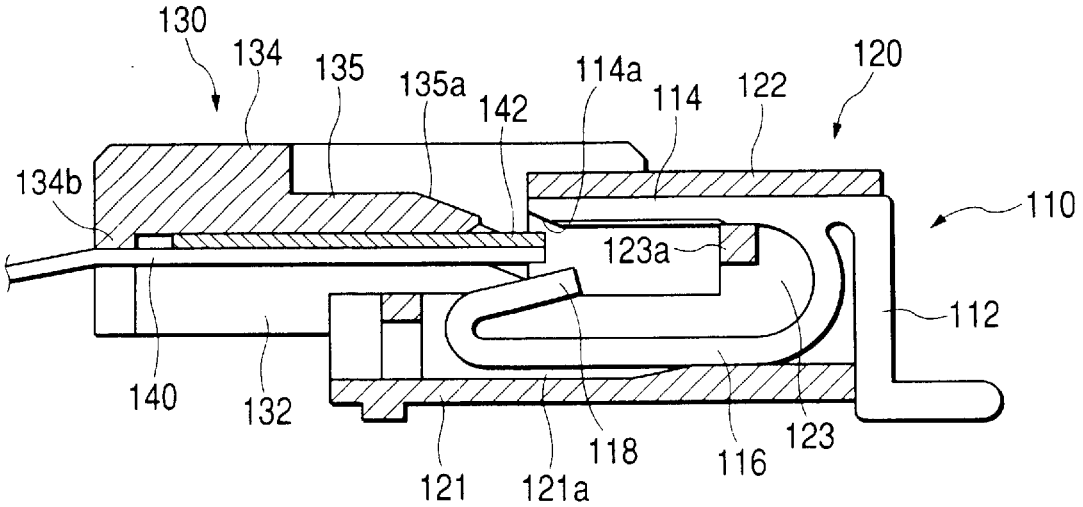
Figure 15A:
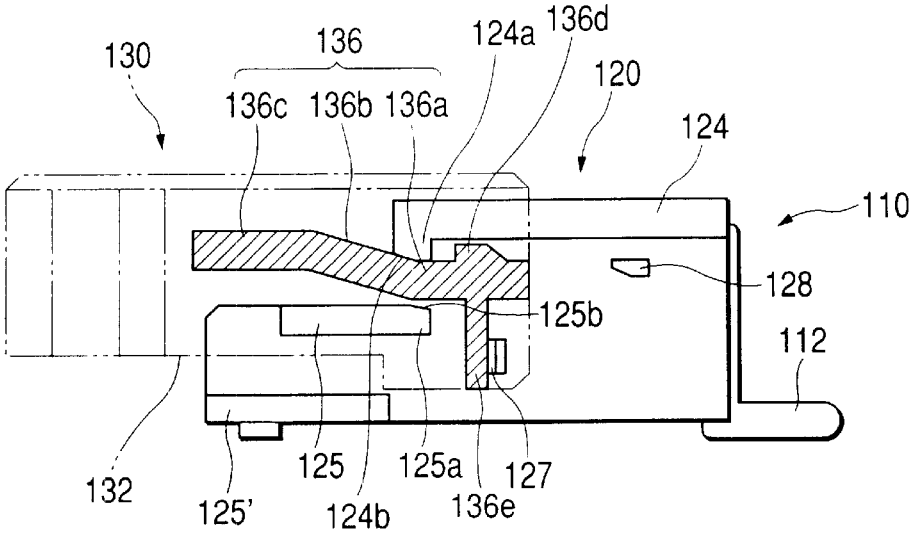
FIGS. 15A and 15E are cross-sectional front elevational views illustrating a state at a point of time when the slider of the connector starts to slide in a first direction.
Figure 15B:
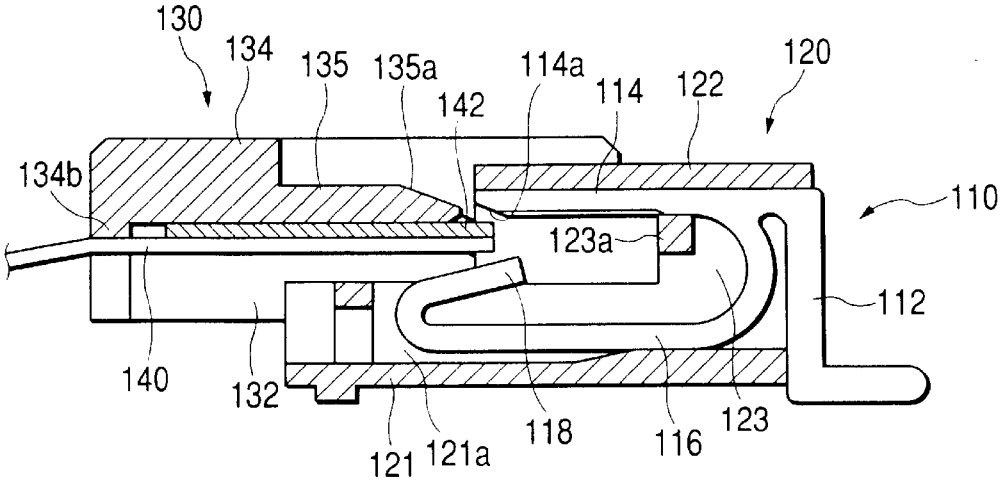
[FIG. 15]

Meanwhile, at both side walls 132 of the slider 130, although each of their guide portions 136 is restrained from upper and lower directions by the projection 124*a* and the rear terminal of the protrusion 125 on the housing 120 side, in the state in which the slider has been pulled out as shown in FIGS. 14A and 14B, since the lower horizontal portion 136*a* which is lowest in the guide portion 136 is restrained as described above, the slider 130 is held at the highest position relative to the housing 120. Accordingly, the insertion gap on the lower side of the slider 130 is large, so that the flexible wiring member 140 can be easily inserted into the housing 120 through that gap.

After the insertion of the flexible wiring member 140, the slider 130 is pushed in toward a rear end side of the housing 120 while causing the vertical portion 136*e* of the slider 130 to ride over the projection 127. In conjunction with this pushing in, the portion of the guide portion 136 which is restrained by the projection 124*a* and the rear terminal of the protrusion 125 gradually changes. However, when the inclined portion 136*b* has come to that restraining position (FIG. 15A), the slider 130 starts to slide diagonally downward at an angle equal to its angle of inclination. Namely, the slider 130 slides in a first direction which is inclined in the direction of approaching the conductor contacting portion 118 of the terminal 110 (diagonally downwardly oriented) with respect to the inserting direction of the flexible wiring member (the horizontal direction in the drawing).

Figure 16A:
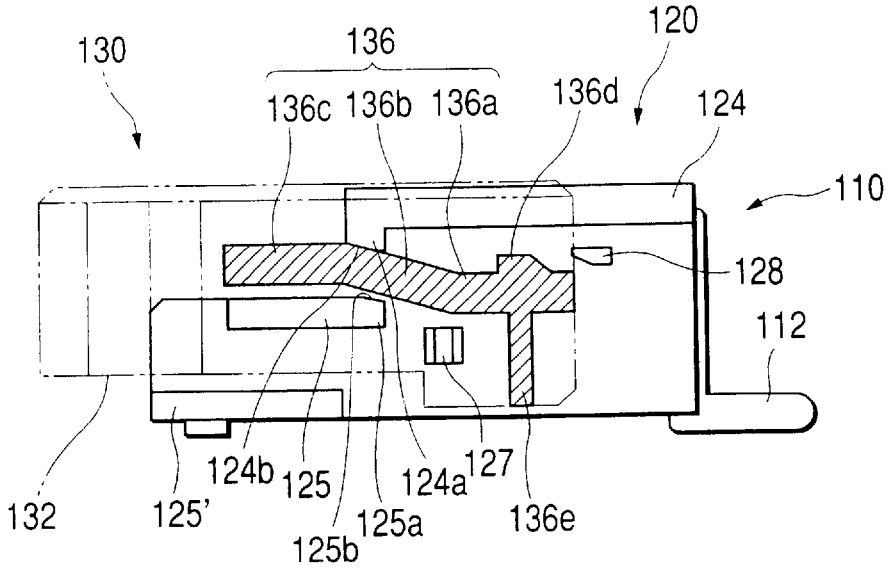
FIGS. 16A and 16B are cross-sectional front elevational views illustrating a state at a point of time when the slider of the connector has completed sliding in the first direction.
Figure 16B:
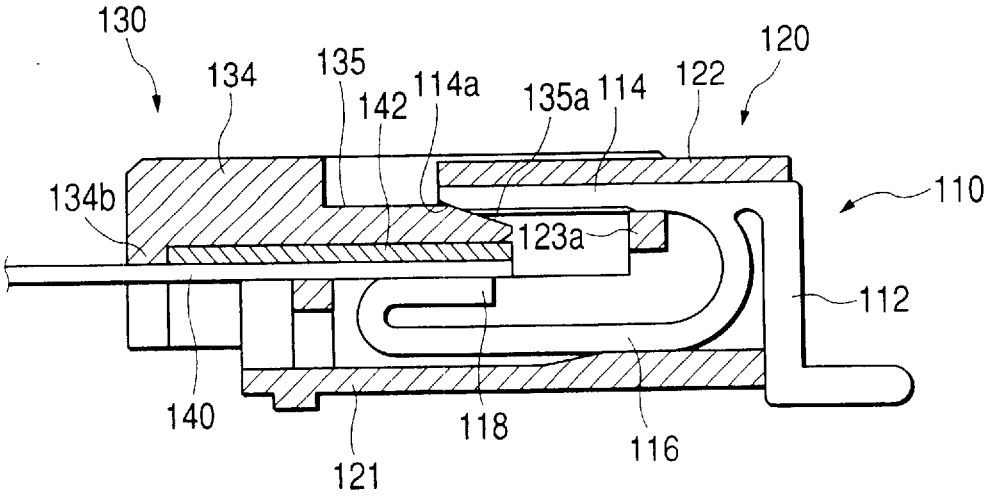

As a result of this diagonal sliding, as shown in FIG. 16B, the wiring-member holding piece 135 of the slider 130 slips onto the lower side of the upper horizontal portion 114 of the terminal 110, and presses the terminal of the flexible wiring member 140 against the conductor contacting portions 118 of the terminals 110. As a result, the conductor-exposed portion of the terminal of the flexible wiring member is brought into pressure contact with each conductor contacting portion 118, thereby allowing the two parts to be electrically connected to each other.

Further, when the upper horizontal portion 136*c* of the guide portion 136 starts to be restrained, as shown in FIG. 16A, the slider 130 slides in a second direction parallel to the inserting direction of the flexible wiring member 140. Then, when the slider 130 has been pushed in to a predetermined depth, the portion to be retained 136*d* rides over (i.e., finally retained by) the retaining projection 128 on the housing 120 side, as shown in FIG. 17A, thereby restraining the backward movement of the slider 130 and maintaining a completely joined state.

Here, even in a case where the insertion of the flexible wiring member 140 has been incomplete at the beginning of the pushing in of the slider 130, as shown in FIG. 14B, since the projecting portion 134*b* projecting downward from the lower surface of the slider 130 pushes from behind the reinforcing plate of the flexible wiring member 140 from the rear side in the inserting direction (from the left-hand side in FIGS. 14A to 17B) in conjunction with the pushing in of the slider 130, the terminal of the flexible wiring member 140 is finally guided reliably to the proper connecting position where the conductors are brought into contact with the conductor contacting portions 118. Accordingly, it is possible to reliably prevent faulty connection ascribable to the incomplete connection of the flexible wiring member 140.

In additions in the state shown in FIGS. 17A and 17B in which the connection has been completed, since the backward movement of the flexible wiring member 140 with respect to the slider 130 is prevented by the abutment between the projecting portion 134*b* and the reinforcing plate 142, even it some tension is applied to the flexible wiring member 140, it is possible to prevent the offsetting of the position of the terminal from the connecting position due to it.

In particular, if the structure provided is such that, as shown in FIG. 17A, the portion to be retained 136*d* is retained by the retaining projection 128 on the housing 120 to retrain the backward movement in the state in which the slider 130 has been completely pushed in, the connected state can be maintained more reliably. Furthermore, it is possible to obtain an advantage in that through the sound and a feeling which occur during the engagement between the portion to be retained 136*d* and the retaining projection 128, an operator is able to confirm that the slider 130 has been completely inserted in the housing 120, and that the terminal of the flexible wiring member 140 has been electrically connected to the terminals 110.

(Other Embodiments)

It should be noted that the invention is not limited to the above-described embodiment and, for example, it is possible to adopt the following embodiment.

(1) In the invention, the inserting direction of the flexible wiring member 140 is not limited and, for example, the terminal of the flexible wiring member may be inserted into the housing downwardly from above. In this case as well, it suffices if an arrangement is provided such that the restaining portion of the slider abuts against the reinforcing plate from the rear side in the inserting direction (i.e., from the upper side).

(2) Although in the above-described embodiment the connector is shown in which the terminal of the wiring member is inserted into the housing 120 from the lower side of the pulled-out slider 130, the terminal of the wiring member may be inserted from the upper side of the pulled-out slider 130. In this case, since the reinforcing plate 142 is fixed to the upper surface of the flexible wiring member 140, it suffices if a restraining portion which can abut against the reinforcing plate 142 is provided on the upper surface of the slider 130.

(3) Although in the above-described embodiment the projecting portion 134*b* is formed at the front end (the rear end in the inserting direction of the flexible wiring member) of the slider 130, the position of the projecting portion 134*b* may be located on a further forward side (the right-hand side in FIGS. 14A to 17B) in the inserting direction of the flexible wiring member than the aforementioned position.

(4) Although in the above-described embodiment the connector is shown in which the slider 130 is slid in the diagonal direction (first direction) and is then slid in a direction (second direction) parallel to the inserting direction of the flexible wiring member, the invention is not limited to the same, and a similar effect can be obtained in the case of a connector in which the slider 130 is slid only in the first direction or in the second direction if the slider is provided with the aforementioned restraining portion.

(5) In the invention, the specific shape and structure of the flexible wiring member 140 is not limited, and the invention is also applicable to other various flat wiring members excelling in flexibility.

(Fourth Embodiment)

Preferred embodiments of the invention are described hereinbelow with reference to FIGS. 20 to 29.

Figure 20:
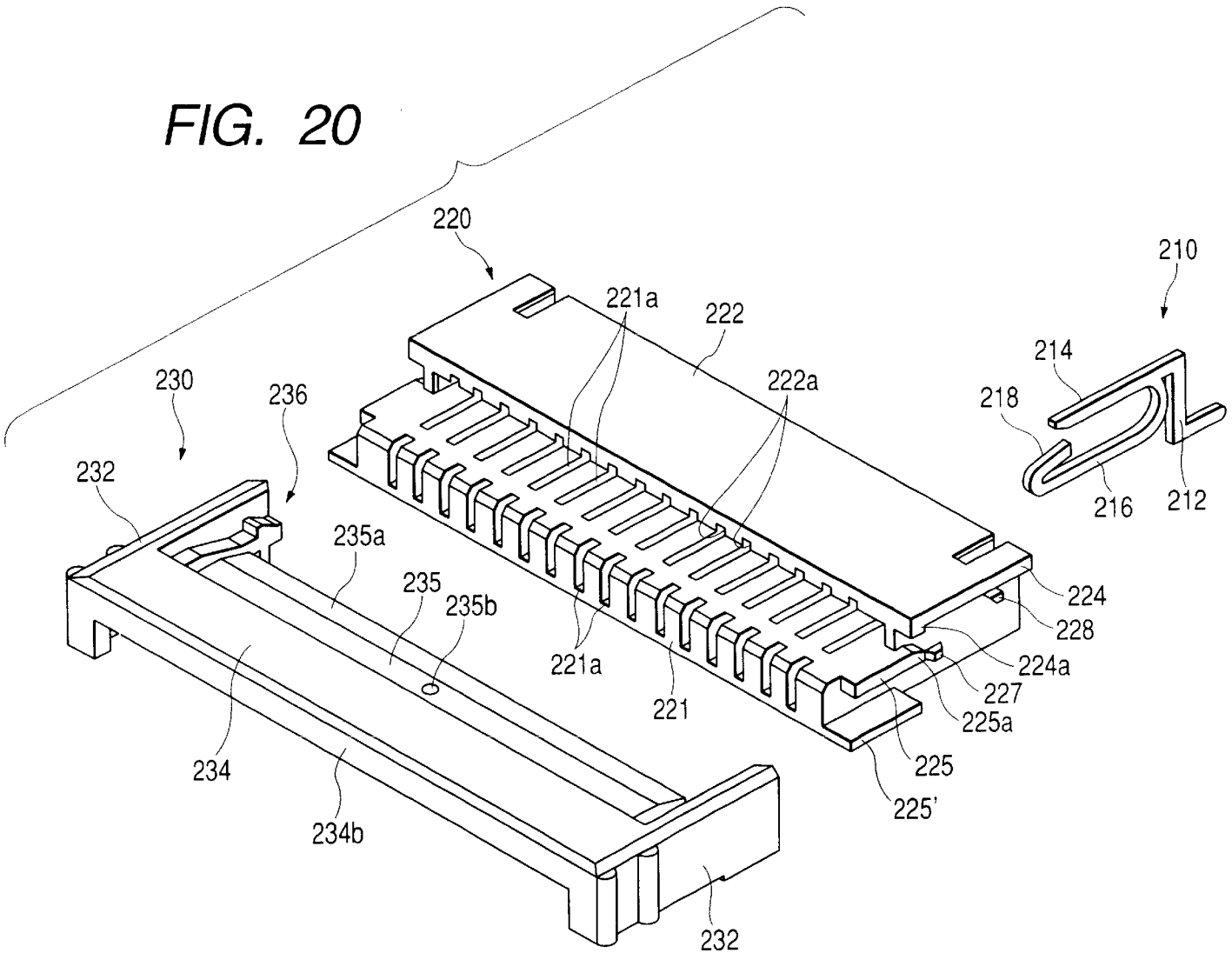
[FIG. 20]
Figure 21:
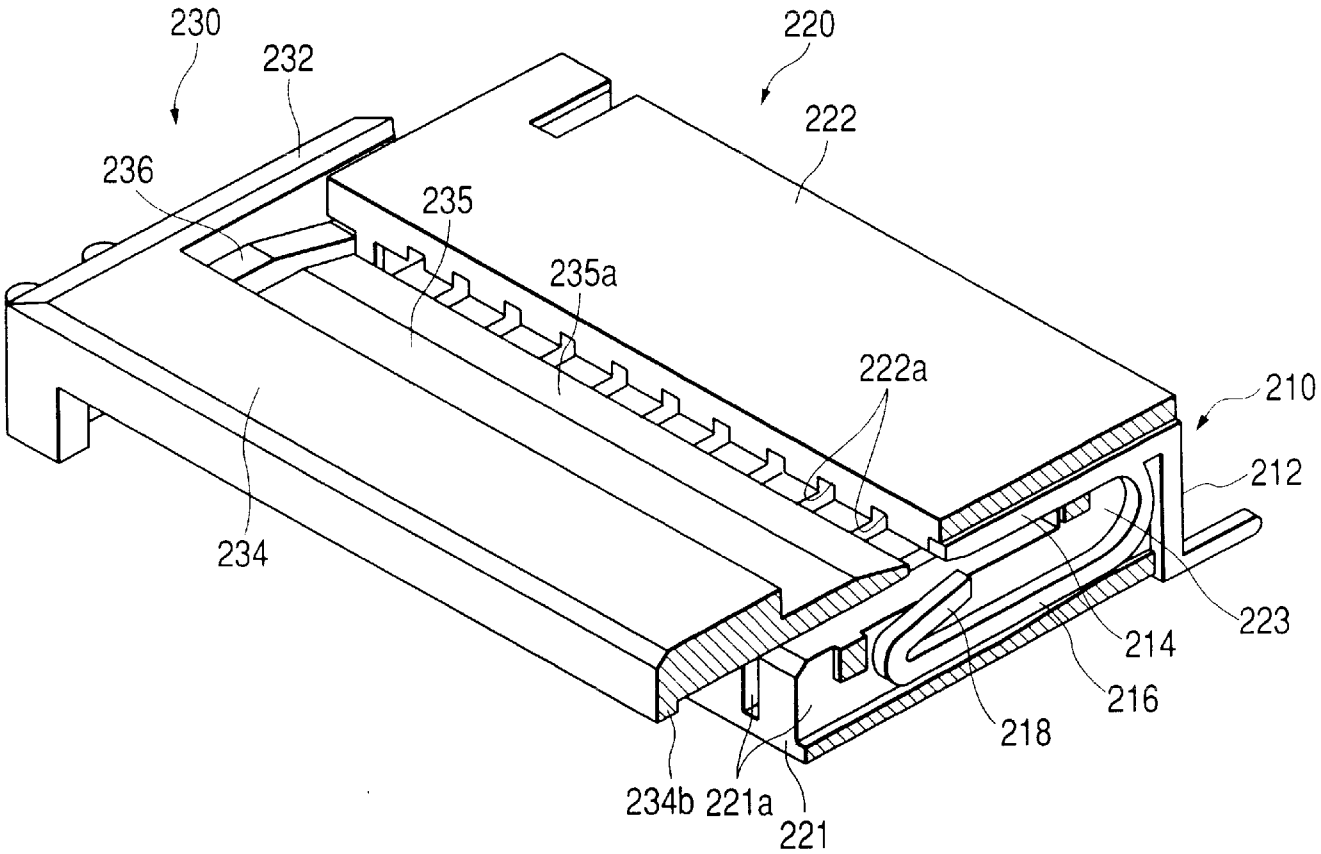
[FIG. 21]

A connector shown in FIG. 20 has many terminals 210, a housing 220 for holding the terminals 210, and a slider 230 attached to this housing 220.

Each of the terminals 210 is made of an electrically conductive material, such as metal, and comprises a nearly L-shaped leg portion 212 mounted on a circuit board, an upper horizontal portion 214 horizontally extending from the top of this leg portion 212, a lower horizontal portion 216 downwardly branched from the base of the upper horizontal portion 214 and extending in parallel with the upper horizontal portion 214, and a conductive contact portion 218 reversed at an acute angle from a terminal of this lower horizontal portion 216 so that these portions are integral with one another. The bottom surface of the front end part of the upper horizontal portion 214 is formed like a slope whose height increases toward the front end part thereof.

The entire housing 220 is integrally formed from an insulating material, such as synthetic resin. Concretely, the housing 220 has a main body 221 extending in a lateral direction, and a ceiling wall portion 222 extending in parallel with this main body 221 above the rear half part thereof. The main body portion 221 and the ceiling wall portion 222 are connected through lateral side walls to each other as one unit.

Terminal accommodating grooves 221*a* adapted to respectively accommodate the lower horizontal portions 216 of the terminals 210 and to extend in forward and rearward directions are formed in the main body portion 221. Further, the terminals 210 are respectively fixed in the terminal accommodating grooves 221*a*. The conductor contact portion 218 of each of the terminals 210 projects upwardly from a corresponding one of the terminal accommodating grooves 221*a*. On the other hand, terminal fitting grooves 222*a*, to each of which the upper horizontal portion 214 of a corresponding one of the terminals 210 is fitted, extending in the frontward and rearward directions are formed in the bottom surface part of the ceiling wall portion 222.

Both lateral terminals of the ceiling wall portion 222 are ridges 224 that outwardly protrude from both lateral side surfaces of the housing 220 and that extend in the frontward and rearward directions. A projection 224*a* downwardly protruding is formed at the front terminal of each of the ridges 224*a*. A tapered surface, whose projection amount increases toward the rear end thereof (that is, increases toward the right end thereof, as viewed in FIG. 22A), is formed on the front side portion of each of the projections 224*a*.

Similarly, a pair of upper and lower ridges 225 and 225' extending in the frontward and rearward directions are formed at front parts of lateral side surfaces of the main body portion 222. A tapered surface 225*b*, whose height gradually decreases toward the rear end thereof, is formed on the rear terminal (that is, the right terminal, as viewed in FIG. 22A) of the ridge 225.

The slider 230 is integrally formed from an insulating material, similarly as the housing 220. Further, the slider 230 is shaped in such a way as to extend in the direction of width of the flat wiring member 240. Practically, the slider 230 has a pair of lateral side walls 232 extending in the frontward and rearward directions, and a connecting portion 234 for connecting both the side walls 232 to each other in the lateral direction (that is, the direction of width of the flat wiring member 240) so that the side walls 232 and the connecting portion 234 are integral with one another. The distance between both the side walls 232 is set in such a way as to be nearly equal to the lateral dimension of the housing 220. A wiring member pressing piece 235 rearwardly extends from a part, which is other than the lateral terminals, of the rear end surface of the connecting portion 234. A tapered surface 235*a*, whose height decreases toward the rear end thereof, is formed on the top surface part of the rear terminal of this wiring member pressing piece 235.

A guide portion 236 serving as a ridge inwardly protruding is formed on an inner side surface of each of both the side walls 232. The guide portion 236 has a lower horizontal portion 236*a* horizontally extending, an inclined portion 236*b* extending frontwardly and obliquely from the front end of this lower horizontal portion 236*a* in a horizontal direction, and an upper horizontal portion 236*c* horizontally extending frontwardly and obliquely from the front end of this inclined portion 236*b* so that these portions 236*a*, 236*b*, and 236*c* are continuously arranged in this order from the rear end (that is, the right end, as viewed in FIG. 22A). All the portions 236*a*, 236*b*, and 236*c* have height dimensions sufficient to the extent that these portions are fitted into between the projection 224*a* and the ridge 225 of the housing 220 almost without space. That is, the guide portion 236 has a width dimension (namely, a dimension in the upward or downward direction), at which the guide portion 236 is allowed to slide in the longitudinal direction and restrained by the projection 224*a* and the rear terminal 225*a* of the projection 225 from above and below, respectively.

The shape of the guide portion 236 is set in such a way as to cause the guide portion 236 to guide the slider 230 so that the slider 230 performs a specific operation.

A to-be-latched portion 236*d* projecting upwardly is formed on the top surface of the lower horizontal portion 236*a* of the guide portion 236. This to-be-latched portion 236*d* is adapted to touch the projection 224*a* thereby to prevent the slider 230 from frontwardly coming out of the housing 220. Further, a vertical portion 236*e* extends downwardly from an appropriate place on the lower horizontal portion 236*a*.

On the other hand, a projection 227 is formed at a position backwardly adjoining to the vertical portion 236*e* on each of both side surfaces of the housing 220 in a state (that is, a state illustrated in FIG. 22A) in which the slider 230 is completely drawn out. This projection 227 abuts against the vertical portion 236*e* to thereby restrain the slider 230 from accidentally moving in a pushing direction (that is, the rightward direction, as viewed in FIG. 22E), that is, to tentatively latch the slider 230. Further, a latching projection (that is, a latching portion) 228 to be engaged with the projection 236*d* in a state (that is, a state in illustrated in FIG. 25A), in which the slider 230 is completely pushed thereinto, is formed on each of both the side surfaces of the housing 220 so that the engagement therebetween restrains the slider 230 from moving back in the direction in which the slider 230 is drawn out (that is, the slider 230 is non-tentatively latched).

At the terminal of the flat wiring member 240 to be fitted into the housing 220, a bottom-surface-side insulating layer is peeled off. Thus, the conductors contained therein are downwardly exposed. On the other hand, a reinforcing plate 242 is fixed to the top-side surface of the terminal by using means, such as glue.

In contrast, a projection portion 234*b*, whose projection amount is nearly equal to that of the reinforcing plate 242, downwardly protruding is formed on the front-end bottom surface of the connecting portion 234 of the slider 230. This projection portion 234*b* abuts against the reinforcing plate 242 from a rear side (that is, the left side, as viewed in FIG. 22B) in the direction, in which the flat wiring member is inserted, thereby to restrain the slider 230 from moving to the front of the flat wiring member 240 (that is, from moving in a direction opposite to the direction in which the flat wiring member is inserted).

Figure 25A:
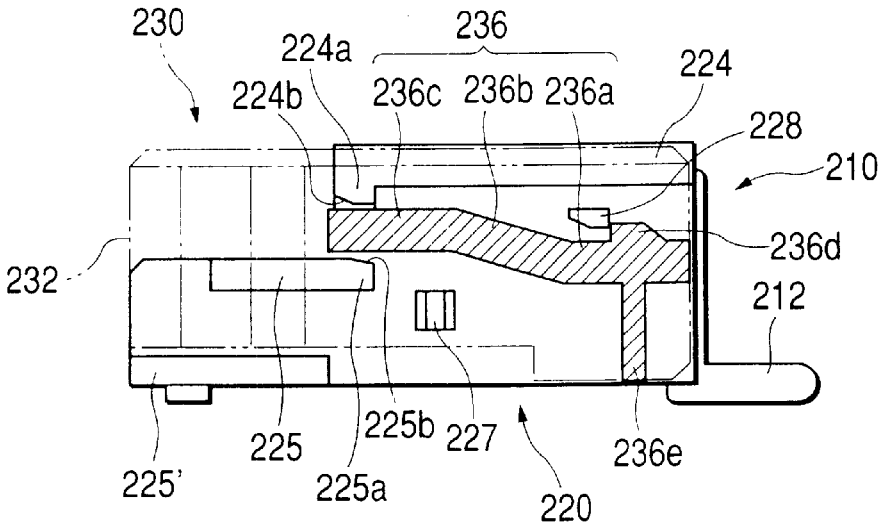
FIGS. 25A and 25B are sectional front views each illustrating a state at the time when the slider of the connector finishes sliding.
Figure 25B:
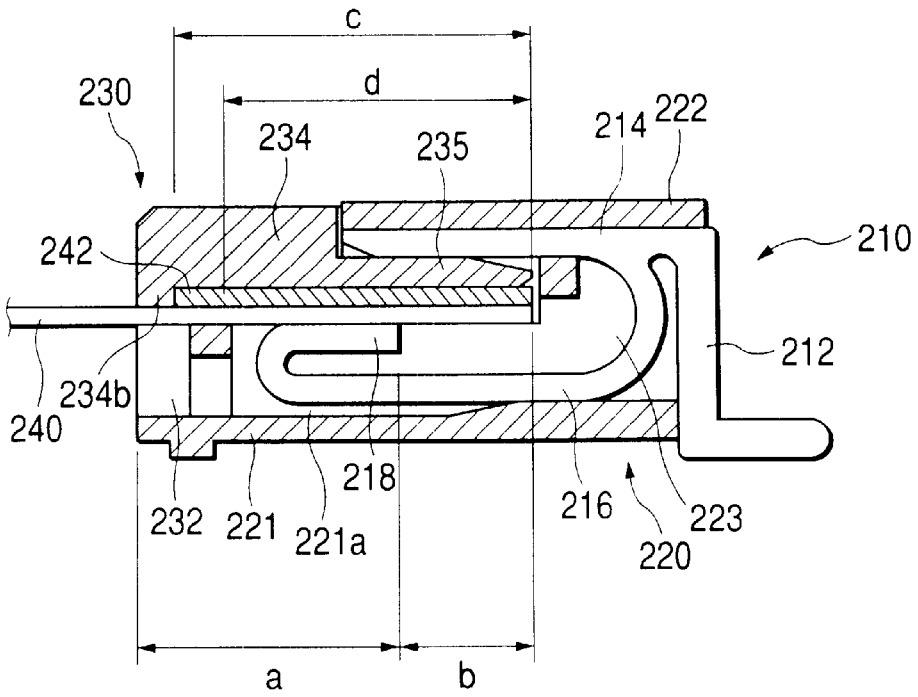

The dimensions in the forward and rearward directions of this connector are set as illustrated in FIG. 25B. That is, let a, b, c, and d respectively designate the distance between the front end (namely, the left end, as viewed in this figure) of the slider 230 and the rear end of the conductor contact portion 218 in a state, in which the slider 230 is completely pushed into the housing 220 as illustrated in this figure, the distance between the rear end of the conductor contact portion 218 and the inserted end of the flat wiring member 240, the dimension in the direction, in which the wiring member 240 is inserted, of the reinforcing plate 242 fixed to the flat wiring member 240, and the dimension in the direction, in which the flat wiring member is inserted, of a region, from which the bottom-surface-side insulating layer is peeled off, of the terminal of the flat wiring member. The dimensions a, b, c, and d are set in such a way as to satisfy the following relation:

$$b<d<c<(a+b)$$

Figure 26:
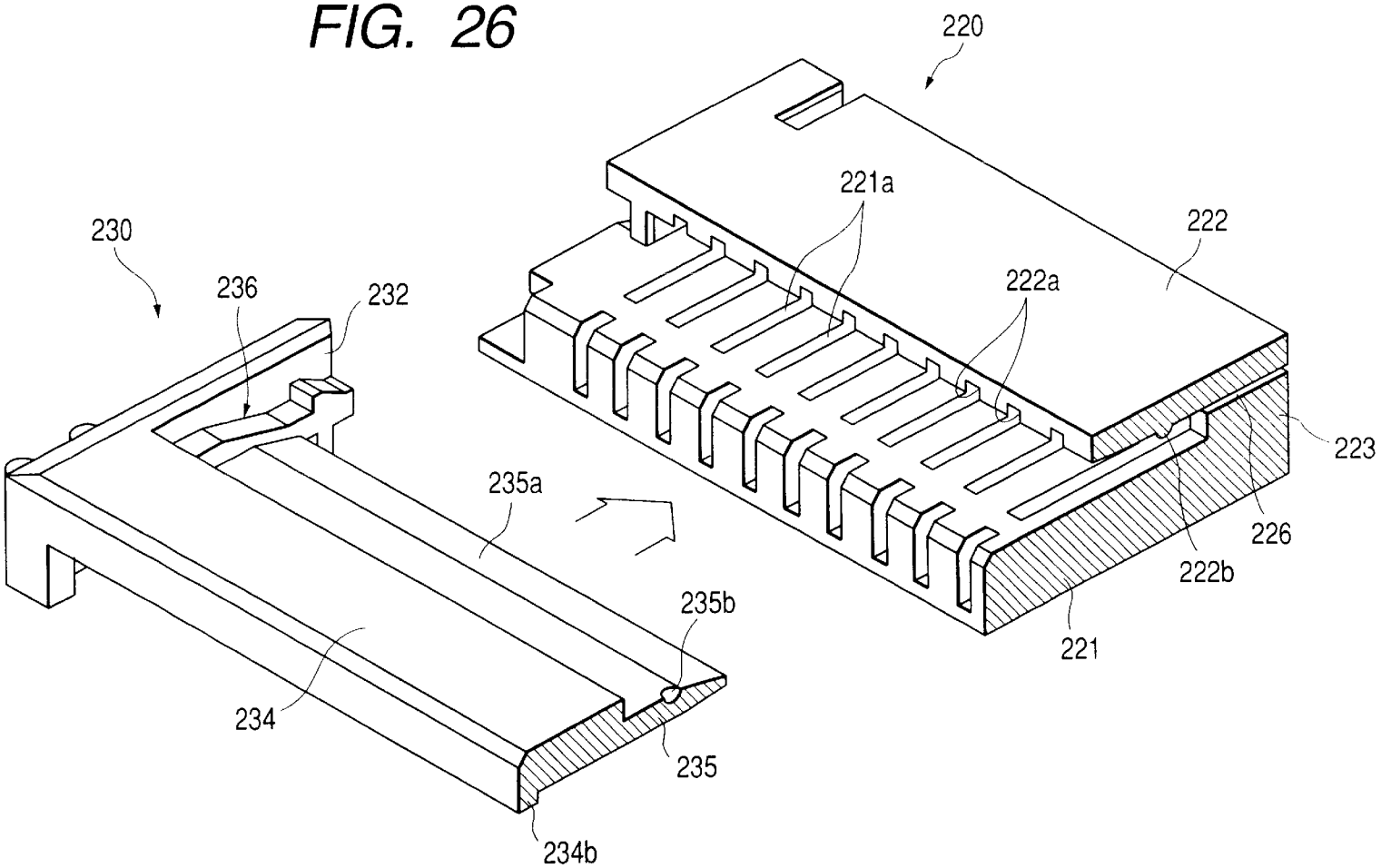
[FIG. 26]
Figure 27A:
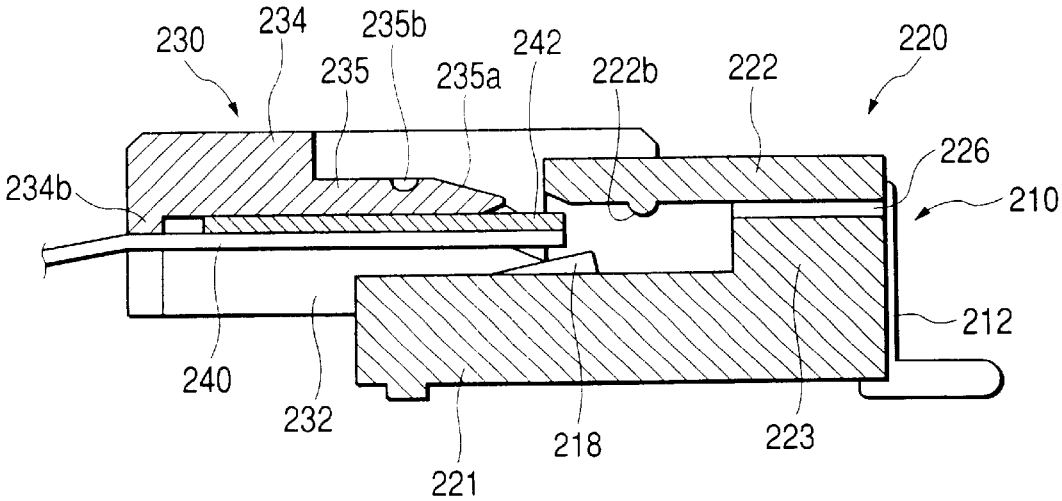
FIG. 27A is a sectional front view illustrating a state before the slider is pushed into the housing.
Figure 27B:
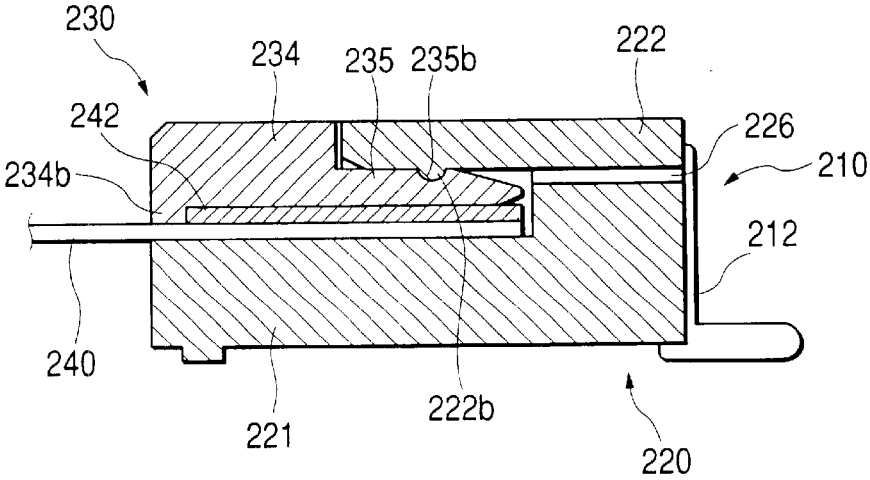
FIG. 27B is a sectional front view illustrating a state after the slider is pushed thereinto.

Furthermore, as illustrated in FIG. 26, the following features of this connector are formed. That is, in a middle portion in the direction of width (that is, the lateral direction) of the wiring member pressing piece 235 in the slider 230, a to-be-latched portion 235*b* recessed from the top surface of the middle portion is formed. Moreover, on the back surface of the ceiling wall portion 222 of the housing 220, projections (that is, latching portions) protruding downwardly (namely, in a direction nearly perpendicular to the direction in which the slider 230 is pushed) are formed in such a way as to be integral with the housing 220. Furthermore, the projections 222*b* put in a state (that is, a state illustrated in FIGS. 25A and 25B and FIG. 27B), in which the slider 230 is completely pushed in the housing 220, are fitted into the to-be-latched portion 235*b* thereby to restrain the middle portion in the direction of width of the slider 230, in which the to-be-latched portion 235*b* is provided, from bending in the direction in which the slider 230 is pushed.

An operation of this connector is described hereinbelow.

Figure 22A:
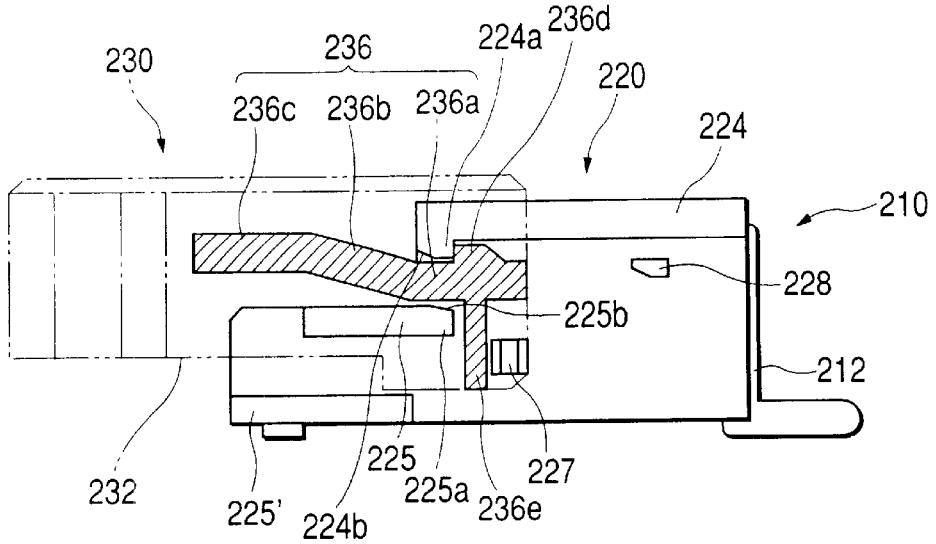
FIGS. 22A and 22B are sectional front views each illustrating a state in which a slider of the connector is completely drawn therefrom.

First, as illustrated in FIG. 22A, the slider 230 is completely drawn out of the housing 220 to the front side thereof. At that time, the projection 236*d* formed in the guide portion 236 of the slider 230 abuts against the projection 224*a* formed in the ridge 224 at the side of the housing 220 from the rear side thereof. Consequently, the slider 230 (in a tentatively latched state) is prevented from coming out of the housing 220.

During this state, a terminal of the flat wiring member 240 is inserted into a space between the upper horizontal portion 214 and the conductor contact portion 18 of each of the terminals 210 in the housing 220 from below the connecting portion 234 and the wiring member pressing piece 235 of the slider 230.

Figure 22B:
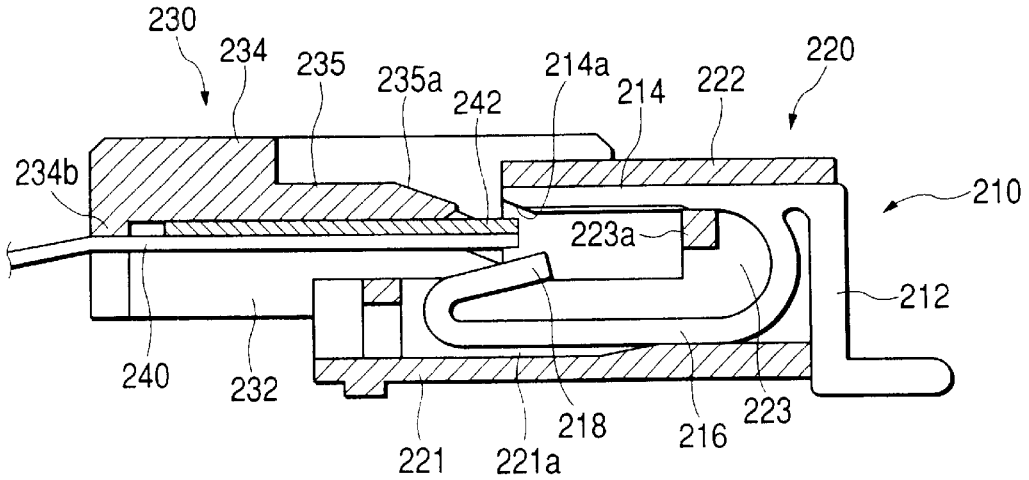
Figure 23A:
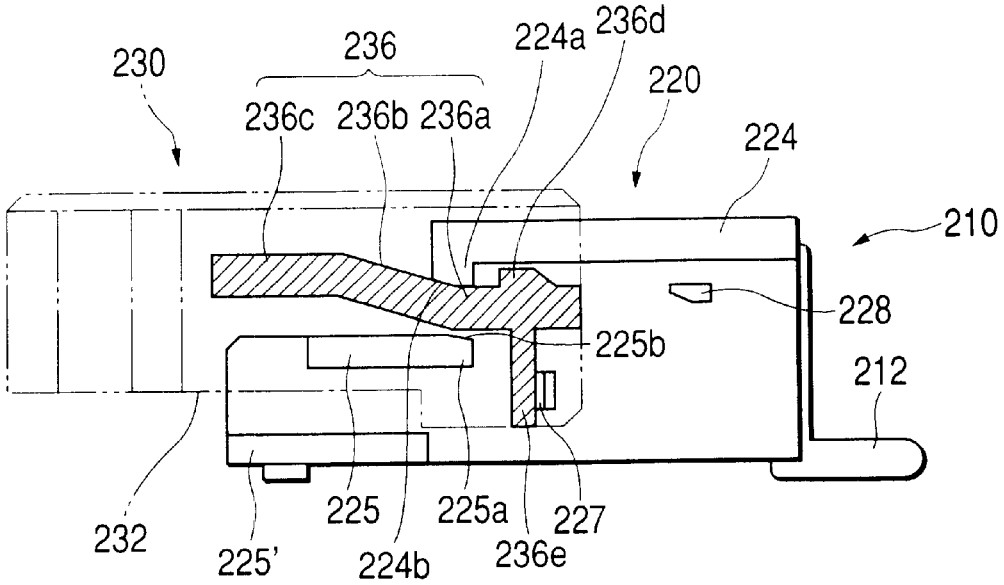
FIGS. 23A and 23B are sectional front views each illustrating a state at the time when the slider of the connector starts sliding in a first direction.
Figure 23B:
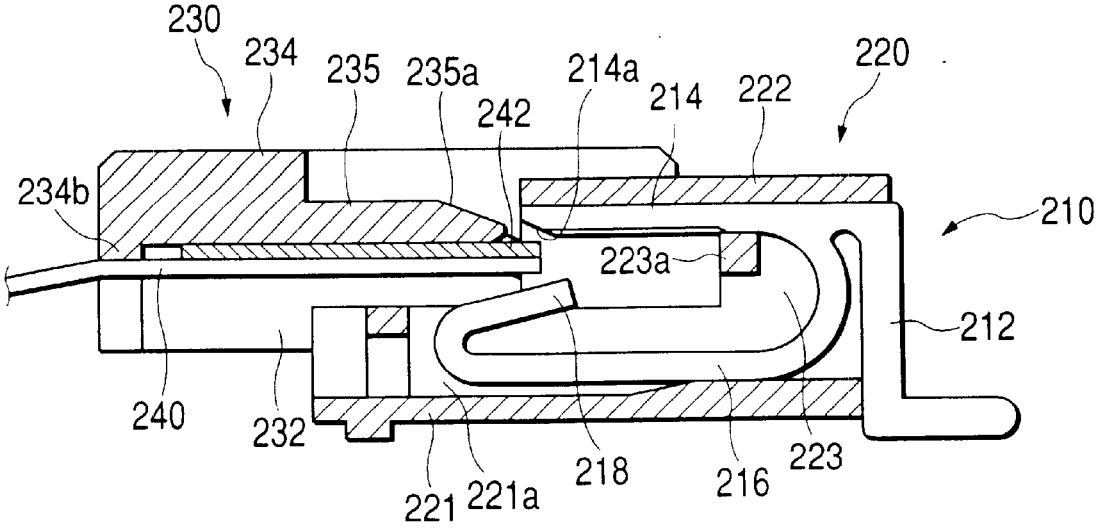

Ideally, the terminal of the flat wiring member 240 is deeply inserted to a position, at which the terminal thereof touches the innermost end of the housing 220, that is, the front end 223*a* of the connecting portion 223 (see FIG. 22B), or to a position near thereto. However, in the case of the connector illustrated in this figure, the projection portion 234*b* downwardly protruding, which is formed at the front terminal of the slider 230 as will be described later, has a function of pushing the reinforcing plate 242 of the flat wiring plate 240 into the innermost end of the housing 220 from the front side thereof. Thus, even when the flat wiring member 240 is inserted to a rather shallow position as illustrated in FIG. 22B, the flat wiring member 240 can be finally inserted to a normal connection position.

On the other hand, the guide portion 236 provided on each of both the side walls 232 of the slider 230 is restrained by the projection 224*a* of the housing 220 and the rear terminal of the ridge 225 from above and below. However, in the state, in which the slider 230 is drawn out as shown in FIGS. 22A and 22B, the lowest lower-side linear portion 236*a* is restrained as described above, so that the slider 230 is held at the relatively highest position with respect to the housing 220. Thus, an insertion portion provided at the lower side of the slider 230 is wide, so that the flat wiring member 240 is easily inserted into the housing therefrom.

After the flat wiring member 240 is inserted, the vertical portion 236*e* of the slider 230 is caused to get over the projection 227. Then, the slider 230 is pushed into the housing 220 toward the rear end thereof. As the slider 230 is pushed thereinto, a part thereof, which is restrained by the projection 224*a* and the rear terminal of the ridge 225, gradually changes. When the inclined portion 236*b* reaches the restrained part (see FIG. 23A), the slider 230 starts sliding downwardly and obliquely at an angle that is equal to an angle of inclination of the inclined portion 236*b*. That is, the slider 230 thence slides in a first direction inclined to a direction (that is, a horizontal direction, as shown in this figure), in which the flat wiring member 240 is inserted, in a (downward) orientation in which the slider 230 approaches the conductor contact portion 218 of the terminal 210.

Figure 24A:
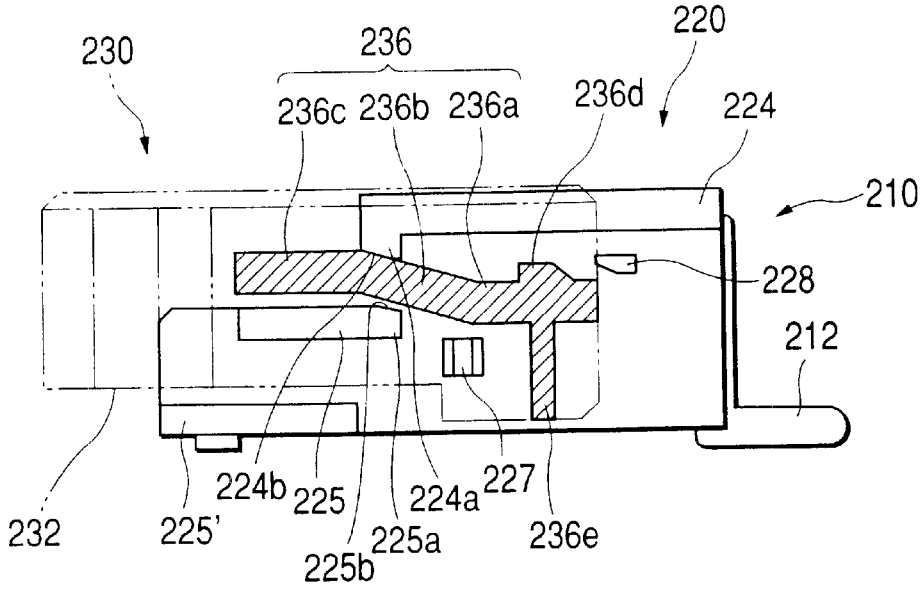
FIGS. 24A and 24B are sectional front views each illustrating a state at the time when the slider of the connector finishes sliding in the first direction.
Figure 24B:
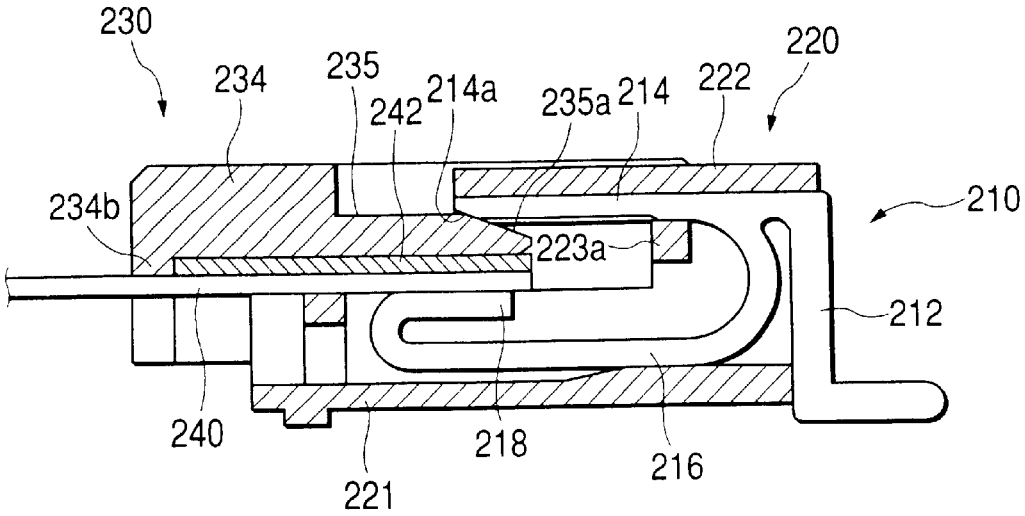

As a result of this obliquely sliding operation, the wiring member pressing piece 235 of the slider 230 gets under the upper horizontal portion 214 of the guide portion 236 and presses the terminal of the flat wiring member 240 against the conductor contact portion 218 of the terminal 210, as illustrated in FIG. 24B. Consequently, the exposed conductive part of the terminal of the flat wiring member is pressure-contacted with the conductor contact portion 218, and thus electrically conducted to each other.

Then, as illustrated in FIG. 24A, the upper horizontal portion 236*e* of the guide portion 236 is restrained. From that time, the slider 230 slides in a second direction that is parallel to the direction, in which the flat wiring member 240 is inserted. Thereafter, when the slider 230 is pushed to a predetermined depth, the to-be-latched portion 236*d* gets over the latching projection 229 of the housing 220 (that is, the portion 236*d* is non-tentatively latched), as illustrated in FIG. 25A. Thus, the slider 230 is restrained from going back. Consequently, a complete connection state is maintained.

Incidentally, in the conventional connector, the middle portion in the direction of width of the slider 230 freely operates in a direction in which the slider 230 is pushed into the housing 220. Thus, the conventional connector has a drawback in that the conventional connector easily bends in such a direction. In contrast, in the connector of this embodiment, the projection 222*b* of the housing 220 is fitted into the to-be-latched portion 235*b* provided in the middle portion in the direction of width of the slider 230 (see FIG. 27B). Thus, the middle portion in the direction of width of the slider 230 is restrained from bending in the direction (that is, a lateral direction in FIG. 27B). Therefore, a contact failure between the terminal of the flat wiring member and the conductor contact portion 218 of each of the terminals 10 is prevented from occurring owing to the bend of the middle portion. Moreover, the connection state between the conductors of the flat wiring member 240 and the terminals 210 is reliably maintained over the entire region in the direction of width of the flat wiring member, which includes the middle portion in the direction of the slider 230.

Moreover, in this embodiment, the projections 222*b* serving as the latching portions are formed in such a way as to be integral with the housing 220. Thus, the bend of the slider 230 is restrained by employing a simple configuration without increasing the number of components.

Figure 28A:
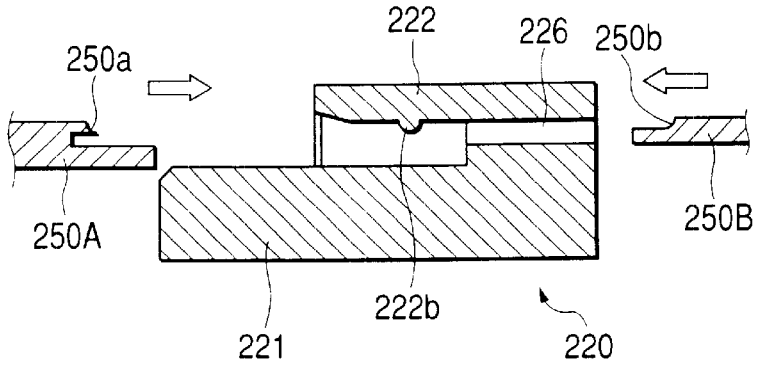
FIGS. 28A to 28C are sectional front views illustrating the shape of a mold used in the case of forming latching portions of various shapes, and also illustrating a direction in which the mold is drawn.

Incidentally, even in the case of a connector of another configuration other than the aforementioned configuration, the slider 230 can be restrained from bending. For example, even in the case that a connector has a configuration in which concave portions 222*c* provided shown in FIG. 28B or through hoes 222*d* shown in FIG. 28C are provided in a housing 220, and in which projections to be engaged with the concave portions 222*c* or the through holes 222*d* are provided on the slider 230, the slider 230 is restrained from bending. Incidentally, it is preferable for integrally forming the entire housing 220 by using synthetic resin that the projections 222*b* are provided in the housing 220.

Figure 28B:
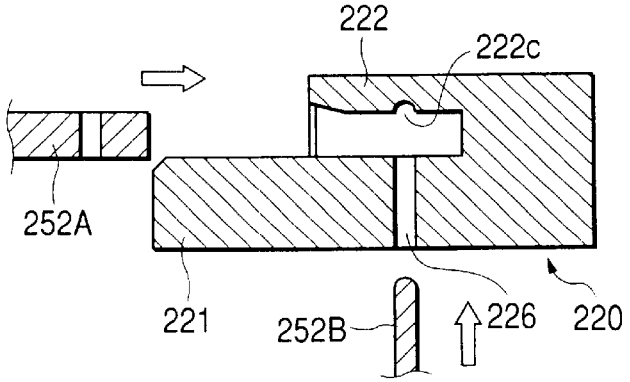
Figure 28C:
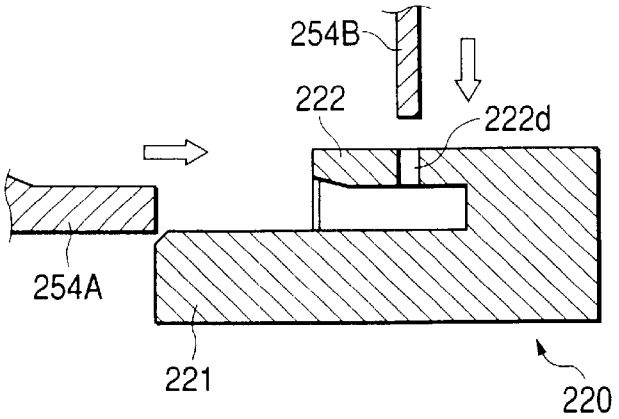

That is, because the insertion portion for inserting the slider 230 and the flat wiring member 240 is formed in the housing 220, there is the necessity for drawing out a mold 252A (see FIG. 28B) and a mold 254A (see FIG. 28C) in a direction nearly parallel to the direction, in which the slider 230 and the flat wiring member 240 are inserted, as illustrated in FIGS. 28B and 28C. On the other hand, it is necessary for forming the concave portion 222*c* and the through hole 222*d* as the latching portion that a pin 252 for forming the concave portion 222*c* and a pin 254B for opening the through hole 222*d* are drawn out in a direction (that is, an upward or downward direction, as shown in these figure) perpendicular to the direction, in which the slider 230 is pushed. Therefore, a plurality of molds should be drawn out in a plurality of different directions. Consequently, the equipment therefor becomes complex.

In contrast, in the case that the projection 222*b* is formed in the housing 220, as shown in FIG. 28A, it is sufficient to draw out molds 250A and 250B respectively having concave surfaces 250*a* and 250*b* obtained by halving the projection 222*b* are drawn out in a direction (that is, a lateral direction, as viewed in the figure) parallel to the direction, in which the slider 230 and the flat wiring member 240 are inserted. Thus, the directions, in which the forming molds are drawn out, are the same as each other. Consequently, the structure of the equipment is simple.

Incidentally, in FIGS. 28A to 28C, reference numeral 226 designates a mold drawing hole.

Figure 29:
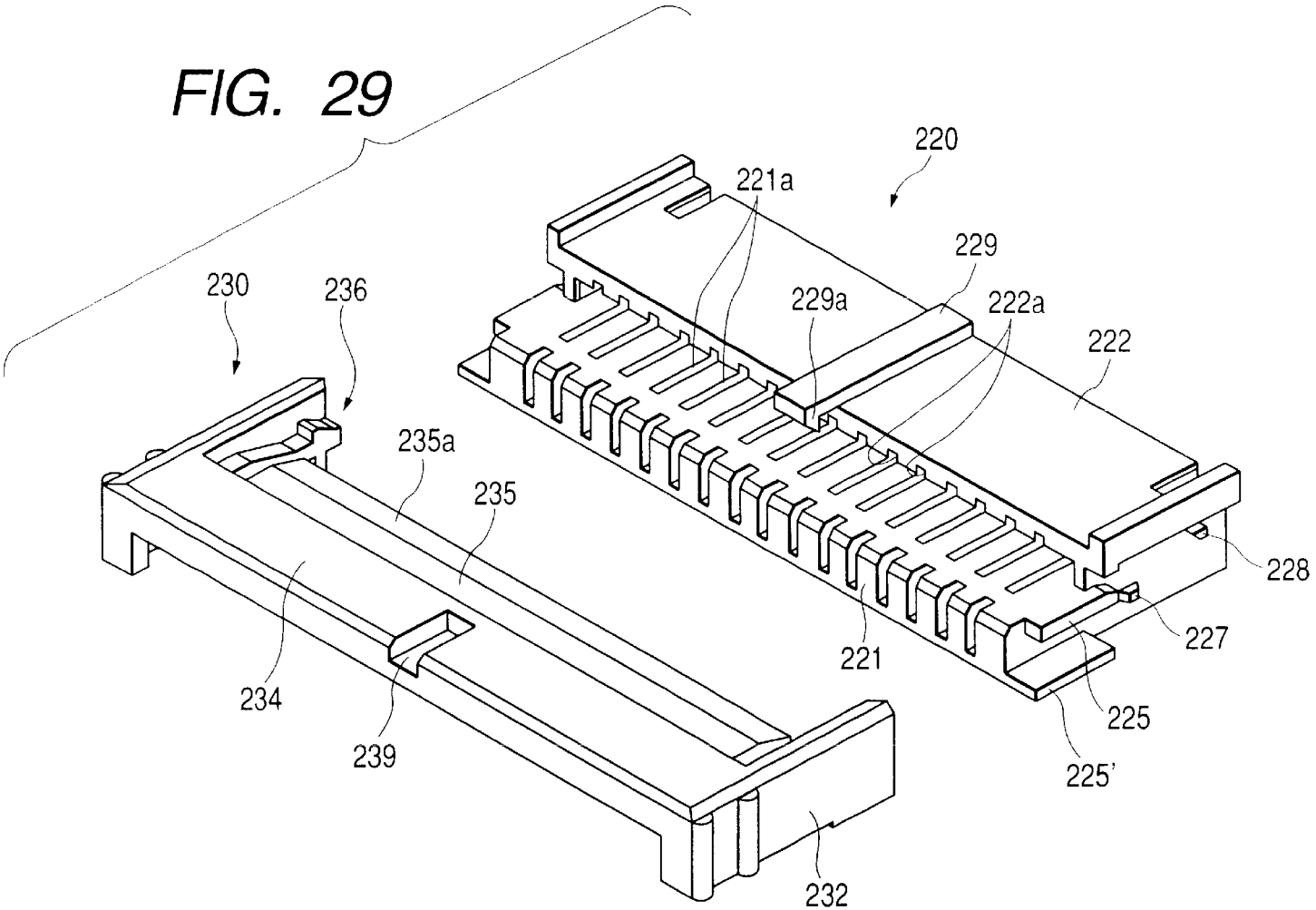
[FIG. 29]

Additionally, the latching portions provided in the housing 220 are not limited to the projections 222*b*, the concave portions 222*c*. For example, the latching portion may be configured by extending an arm portion 229 from the top surface of the ceiling wall portion 222 of the housing 220 to the slider 230, as illustrated in FIG. 29, and forming a latching projection 229*a* at the terminal thereof, and a concave portion 239 in the top surface part of the connecting portion 234 and fitting the latching projection 229*a* of the arm portion 229 into the concave portion 239 during the slider 230 is pushed into the housing 220.

(Other Embodiments)

In addition, the invention can provide the following embodiments.

(1) The direction, in which the flat wiring member 240 is inserted, is not limited to a specific direction. According to the invention, the flat wiring member may be inserted into the housing from above to below.

(2) Although the connector, in which the terminal of the wiring member is inserted into the housing 220 from below the drawn slider 230, has been described in the foregoing description of the embodiment, the terminal of the wiring member may be inserted thereinto from above the slider 230. In this case, it is sufficient that the to-be-latched portion is formed, for instance, on the bottom surface of the slider 230.

(3) Although the embodiment, in which the slider 230 is adapted to first slide in an oblique direction (namely, a first direction) and then slide in a (second) direction parallel to the direction, in which the flat wiring member is inserted, has been described in the foregoing description, the invention is not limited to such an embodiment. A connector, in which the slider 230 slides only in a first or second direction, can obtain effects similar to those of such an embodiment by providing a to-be-latched portion in the slider and by providing latching portions in a housing.

(4) In connectors of the invention, the shape and configuration of the flat wiring member 240 are not limited to specific ones. The invention can be applied to cases of employing various flat wiring members, which excel in flexibility, such as FFC and FPC.

EFFECTS OF THE INVENTION

As described above, in the invention, in a connector for a flexible wiring member, a guiding mechanism is provided for guiding the slider such that when the slider is pushed into the housing with the flexible wiring member inserted therein, the slider slides in the first direction which is inclined in a direction of approaching the conductors of the flexible wiring member with respect to the inserting direction of the flexible wiring member, and subsequently slides in the second direction parallel to the inserting direction of the flexible wiring member. Therefore, there is an advantage in that while a wide insertion gap is secured for the flexible wiring member to facilitate the insertion in the state in which the slider has been pulled out, the connection between the flexible wiring member and the terminals can be reliably and stably maintained by the subsequent sliding in the first direction and the second direction.

Further, as described above, the restraining portion is provided on the slider which is pushed into the housing, and the movement of the flexible wiring member in a direction opposite to the inserting direction of the flexible wiring member is restrained by abutment between the restraining portion and the reinforcing plate at the terminal of the flexible wiring member. Further, as the slider is pushed into the housing in a state in which the reinforcing plate is located on a further forward side in the inserting direction of the flexible wiring member than the restraining portion, the conductors of the terminal of the flexible wiring member are held at a position for contacting the conductor contacting portions of the terminals. Therefore, there are advantages in that it is possible to reliably effect the connection of the flexible wiring member, and that the state of its connection can be maintained satisfactorily.

Still further, as described above, a connector according to the invention has a to-be-latched portion provided in a middle portion in the direction of width of a slider, and also has latching portions that engage with the to-be-latched portion and that are provided on the side of a housing. The engagement therebetween restrains the middle portion in the direction of width of the slider from bending at a pushing position and in a direction in which the slider is pushed. Thus, the connector of the invention has effects in that even when the width dimension of a flat wiring member is large, a favorable connection state is maintained over the entire region extending in the direction of width thereof.

What is claimed is:

1. A connector to which a terminal of a flat flexible wiring member is connected, comprising:

a housing into which said terminal of said flexible wiring member is insertable;

a plurality of terminals provided in said housing and respectively having conductor contacting portions for contacting conductors at the terminal of said flexible wiring member inserted in said housing; and a slider for restraining said terminal of said flexible wiring member at a position where said conductors are respectively brought into contact with said conductor contacting portions of said terminals as said slider is pushed into said housing in a direction including an inserting-direction component thereof in a state in which said terminal of said flexible wiring member is inserted in said housing; and a guiding mechanism for guiding said slider such that, in conjunction with the pushing in of said slider, said slider is slid in a first direction which is inclined in a direction of approaching said conductors of said flexible wiring member with respect to the inserting direction of said flexible wiring member, and is subsequently slid in a second direction parallel to the inserting direction of said flexible wiring member.

2. The connector according to claim 1, wherein the first direction among the sliding directions of said slider is a diagonally downward direction, and said flexible wiring member is arranged to be inserted into said housing from a lower side of said slider.

3. The connector according to claim 1, wherein said housing includes a retaining portion for retaining said slider which slid to an innermost side in the second direction to restrain the backward movement thereof.

4. The connector according to claim 3, wherein the first direction among the sliding directions of said slider is a diagonally downward direction, and said flexible wiring member is arranged to be inserted into said housing from a lower side of said slider.

5. The connector according to claim 1, wherein as said guiding mechanism, a guide portion which is formed by one of a protrusion and a groove and in which a first guide portion extending in the first direction and a second guide portion extending in the second direction continue is provided on one of said housing and said slider, while a restraining portion which, while being fitted to said guide portion, restrains the movement of said guide portion in a direction perpendicular to a longitudinal direction of said guide portion while permitting the sliding of said guide portion in the longitudinal direction thereof.

6. The connector according to claim 5, wherein said housing includes a retaining portion for retaining said slider which slid to an innermost side in the second direction to restrain the backward movement thereof.

7. The connector according to claim 5, wherein the first direction among the sliding directions of said slider is a diagonally downward direction, and said flexible wiring member is arranged to be inserted into said housing from a lower side of said slider.

8. The connector according to claim 5, wherein said guide portion is provided projectingly on said slider, a portion to be retained is provided integrally with said guide portion, and said housing includes a retaining portion for restraining the backward movement of said slider by engaging said portion to be retained of said slider which has slid to an innermost side in the second direction.

9. The connector according to claim 8, wherein the first direction among the sliding directions of said slider is a diagonally downward direction, and said flexible wiring member is arranged to be inserted into said housing from a lower side of said slider.

10. The connector according to claim 8, wherein said housing includes a stopper for preventing said slider from coming off said housing in a direction opposite to the pushing-in direction of said slider as said stopper abuts against said guide portion.

11. The connector according to claim 10, wherein the first direction among the sliding directions of said slider is a diagonally downward direction, and said flexible wiring member is arranged to be inserted into said housing from a lower side of said slider.

12. A connector to which a terminal of a flat flexible wiring member with a reinforcing plate fixed to the terminal is connected, comprising:

a housing into which the terminal of said flexible wiring member is insertable;

a plurality of terminals provided in said housing and respectively having conductor contacting portions for contacting conductors at the terminal of said flexible wiring member inserted in said housing; and a slider for restraining the terminal of said flexible wiring member at a position where said conductors are respectively brought into contact with said conductor contacting portions of the terminals, wherein said slider includes a restraining portion thereon for restraining the movement of said flexible wiring member in a direction opposite to an inserting direction of paid flexible wiring member as said restraining portion abuts against said reinforcing plate in the inserting direction of said flexible wiring member, and as said slider is pushed into said housing in a state in which said reinforcing plate is located on a further forward side in the inserting direction of said flexible wiring member than said restraining portion, said conductors of the terminal of said flexible wiring member are held at a position for contacting said conductor contacting portions of the terminals.

13. The connector according to claim 12, wherein said flexible wiring member is inserted into said housing in a state in which a surface of said flexible wiring member on which said reinforcing plate is provided is oriented to oppose said slider, and a projecting portion projecting from said surface toward said flexible wiring member is provided as said restraining portion on a surface of said slider for opposing the flexible wiring member.

14. The connector according to claim 12, wherein said housing includes a retaining portion thereon for retaining said slider pushed into restrain the backward movement of said slider, and a position of retaining said slider by said retaining portion is set so that as said slider is retained by said retaining portion in a state in which said reinforcing plate is located on a further forward side in the inserting direction of said flexible wiring member than said restraining portion, said conductors of the terminal of said flexible wiring member are held at the position for contacting said conductor contacting portions of the terminals.

15. The connector according to claim 14, wherein said flexible wiring member is inserted into said housing in a state in which a surface of said flexible wiring member on which said reinforcing plate is provided is oriented to oppose said slider, and a projecting portion projecting from said surface toward said flexible wiring member is provided as said restraining portion on a surface of said slider for opposing the flexible wiring member.

16. A connector, to which a terminal of a flat wiring member is connected, comprising:

a housing in which said terminal of said flat wiring member enabled to be inserted;

terminals provided in said housing and adapted to touch conductors of said terminal of said flat wiring member; and a slider adapted to extend in a direction of width of said flat wiring member and to restrain conductors of said terminal of said flat wiring member in a position, in which said conductors of said terminal of said flat wiring member touch said terminal, by being pushed into said housing in a direction including a component of a direction in which said flat wiring member is inserted thereinto, wherein a to-be-latched portion is provided in a middle portion in the direction of width of said slider, and wherein latching portions for restraining said middle portion by engaging with said to-be-latched portion of said slider, which is pushed into said housing, from bending in the direction, in which said slider is pushed into said housing, are provided in said housing.

17. The connector according to claim 16, wherein said latching portions are formed in such a way as to be integral with said housing.

18. The connector according to claim 16, wherein said housing and said latching portions are integrally formed with one another by using synthetic resin, and projections protruding from a surface of said housing in a direction nearly orthogonal to a direction, in which said slider is pushed into said housing, are formed as said latching portions.

* * * * *